US009597766B2

(12) United States Patent
Hayashi et al.

(10) Patent No.: US 9,597,766 B2
(45) Date of Patent: Mar. 21, 2017

(54) BRUSH UNIT, A DEVICE FOR BRUSH-POLISHING THAT USES THE BRUSH UNIT, A SYSTEM FOR BRUSH-POLISHING, AND A METHOD FOR BRUSH-POLISHING

(71) Applicant: SINTOKOGIO, LTD., Nagoya-shi, Aichi (JP)

(72) Inventors: Tsuguhito Hayashi, Toyokawa (JP); Youichiro Hiratsuka, Aichi (JP); Shigeru Tanahashi, Aichi (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 0 days.

(21) Appl. No.: 14/763,224

(22) PCT Filed: Jan. 20, 2014

(86) PCT No.: PCT/JP2014/050887
§ 371 (c)(1),
(2) Date: Jul. 24, 2015

(87) PCT Pub. No.: WO2014/122968
PCT Pub. Date: Aug. 14, 2014

(65) Prior Publication Data

US 2015/0367477 A1 Dec. 24, 2015

(30) Foreign Application Priority Data

Feb. 5, 2013 (JP) ..... 2013-020004

(51) Int. Cl.
*B24B 29/00* (2006.01)
*B24B 27/00* (2006.01)
(Continued)

(52) U.S. Cl.
CPC ..... *B24B 29/005* (2013.01); *B24B 9/00* (2013.01); *B24B 9/002* (2013.01);
(Continued)

(58) Field of Classification Search
CPC ..... B24B 29/005; B24B 9/00; B24B 9/002; B24B 27/0023; B24B 27/0069; B24B 27/0076; B24B 41/005
(Continued)

(56) References Cited

U.S. PATENT DOCUMENTS 2,355,601 A * 8/1944 Cudini ..... B24B 9/00 29/11
2,706,875 A * 4/1955 Higley ..... B24D 9/08 451/270
(Continued)

FOREIGN PATENT DOCUMENTS

CN 101118959 A 2/2008
CN 101772835 A 7/2010
(Continued)

OTHER PUBLICATIONS

English-Language International Search Report from the Japanese Patent Office in PCT/JP2014/050887, mailed Apr. 22, 2014.

*Primary Examiner* — George Nguyen
(74) *Attorney, Agent, or Firm* — Finnegan, Henderson, Farabow, Garrett & Dunner, L.L.P.

(57) ABSTRACT

The purpose of the present invention is to provide a device for brush-polishing by means of a polishing brush that rotates and revolves as in a planetary motion, wherein the conditions to polish can be easily set in accordance with the properties of the workpiece and the purposes to polish. A brush unit has a polishing brush that rotates and revolves. The brush unit includes a mechanism for driving the rotation that rotates the polishing brush and the mechanism for
(Continued)

driving the revolution that revolves it. By adjusting the speed of the rotation by the mechanism for driving the rotation the capabilities to polish the workpiece are enhanced. By adjusting the speed of the revolution by the mechanism for driving the revolution the entire workpiece is uniformly polished.

16 Claims, 14 Drawing Sheets

(51) Int. Cl.

| | |
|---|---|
| ***B24B 41/00*** | (2006.01) |
| ***B24B 41/047*** | (2006.01) |
| ***B24B 47/12*** | (2006.01) |
| ***B24D 13/14*** | (2006.01) |
| ***B24B 9/00*** | (2006.01) |

(52) U.S. Cl.
CPC ..... *B24B 27/0023* (2013.01); *B24B 27/0069* (2013.01); *B24B 27/0076* (2013.01); *B24B 41/005* (2013.01); *B24B 41/047* (2013.01); *B24B 47/12* (2013.01); *B24D 13/145* (2013.01)

(58) Field of Classification Search
USPC ..... 451/539, 548–551
See application file for complete search history.

(56) References Cited

U.S. PATENT DOCUMENTS 2,948,087 A * 8/1960 Caton ..... B24B 7/12 15/77
3,696,563 A * 10/1972 Rands ..... B24D 18/00 15/197
3,874,123 A * 4/1975 Hopkins ..... B24B 41/047 451/271
3,992,822 A * 11/1976 Faubel ..... B24B 27/0023 414/223.01
4,078,905 A * 3/1978 Oya ..... B24B 9/00 451/184
4,726,150 A * 2/1988 Nishio ..... B24B 7/16 451/271
4,753,044 A * 6/1988 Bula ..... B23Q 7/047 451/21
5,105,583 A * 4/1992 Hammond ..... B24B 9/00 451/271
5,121,572 A * 6/1992 Hilscher ..... B24B 27/0069 451/262
RE34,014 E * 8/1992 Hundebol ..... B24B 7/00 144/114.1
5,339,569 A * 8/1994 Piggen ..... B24B 9/002 451/247
5,679,067 A * 10/1997 Johnson ..... A46B 3/005 451/527
6,331,138 B1 * 12/2001 Witters ..... B24B 41/047 451/259
6,478,663 B1 * 11/2002 Ganser ..... B24B 17/00 451/271
6,514,129 B1 * 2/2003 Halley ..... B24B 9/065 451/270
6,986,703 B2 * 1/2006 Weber ..... B24B 9/002 451/285
7,081,047 B2 * 7/2006 Palushaj ..... A46B 13/008 451/359
7,140,957 B2 * 11/2006 Thysell ..... B24B 7/186 451/350
7,169,199 B2 * 1/2007 Barber, Jr. ..... B24D 3/004 428/206
7,632,171 B2 * 12/2009 Heesemann ..... B24B 7/06 451/190
7,775,858 B2 * 8/2010 Weber ..... B24B 41/047 451/261
7,988,539 B2 * 8/2011 Palushaj ..... A46B 13/008 451/350
8,469,777 B2 * 6/2013 Nagafuchi ..... A46B 13/006 15/180
8,579,677 B2 * 11/2013 Boudreau ..... B24D 3/28 451/28
8,598,485 B2 * 12/2013 Adachi ..... H01J 37/20 219/121.13
2009/0233529 A1 * 9/2009 Ueda ..... G11B 5/8404 451/41

FOREIGN PATENT DOCUMENTS

| | | | | |
|---|---|---|---|---|
| JP | 4-130151 U | 11/1992 | | |
| JP | 2001-508338 | 6/2001 | | |
| JP | 2003-025200 | 1/2003 | | |
| JP | 2004-142059 | 5/2004 | | |
| JP | 2012-006089 | 1/2012 | | |
| JP | 2012-179691 | 9/2012 | | |
| WO | WO 2009-020050 | 2/2009 | | |
| WO | WO 2015144274 A1 * | 10/2015 | ..... | B24B 29/005 |

* cited by examiner (C)

(A)

(B)

(A)

(B)

BRUSH UNIT, A DEVICE FOR BRUSH-POLISHING THAT USES THE BRUSH UNIT, A SYSTEM FOR BRUSH-POLISHING, AND A METHOD FOR BRUSH-POLISHING

TECHNICAL FIELD

The present invention relates to a brush unit to polish a workpiece (an object to be processed) by a brush (brush-polish a workpiece) for removing burrs, rounding corners, smoothing surfaces, removing microcracks and micropores in surface layers, removing coatings, such as paint, and so on. The present invention also relates to a device for brush-polishing that uses the brush unit and a method for brush-polishing. It also relates to a system for brush-polishing that brush-polishes both sides of a workpiece.

BACKGROUND ART

In a conventional device for brush-polishing, a polishing brush is connected to a motor on the bottom of it, wherein bristles having a capability for polishing are fixed. The tips of the bristles contact a workpiece and the center of the polishing brush is horizontally rotated so as to polish the workpiece by the brush (hereafter, just called "polish") (for example, see the Japanese translation of PCT International Application No. 2001-508338). To improve the capability for polishing of such a device for brush-polishing, increasing the speed of the rotation of the motor is one possible way. However, a motor that has great power is large, so that the entire device for brush-polishing becomes big. Further, due to the increase of the speed of the rotation a problem may occur, such as vibrations or a noise.

A device for brush-polishing that is not big and has a high capability for polishing is disclosed in Japanese Patent Laid-open Publication No. 2004-142058. In that device a polishing brush is horizontally rotated, i.e., rotated about its central axis, and horizontally revolved, i.e., revolved as if in an orbit, because of the rotation of the motor that is connected to the polishing brush. That is, the device for brush-polishing utilizes a planetary motion. In such a device, both the rotation and the revolution are caused by one motor. Thus the motor is subject to a large load. Further, the ratio of the speed of the rotation to that of the revolution is fixed. Thus the ratio is not adjusted in relation to any changes of the properties of the workpieces or the purposes of polishing the workpieces.

The present invention provides a brush unit that polishes a surface of a workpiece to be processed by causing a polishing brush to move as in the planetary motion and that allows an easy adjustment of any condition necessary to polish the workpiece in relation to changes of the properties of the workpieces or the purposes of polishing the workpieces. The invention also provides a device and a method for brush-polishing that use the brush unit. It also provides a system for brush-polishing that polishes both sides of a workpiece.

DISCLOSURE OF INVENTION

The first aspect of the present invention relates to a brush unit to polish a surface of a workpiece to be polished by means of a polishing brush that rotates and revolves in the planetary motion. The brush unit comprises a polishing brush wherein tips of the plurality of bristles are exposed from the bottom of the polishing brush. It also comprises a rotating unit that has a mechanism for rotation, a mechanism for driving the rotation, a mechanism for transmitting the force for the rotation, and a mechanism for vertically moving. The mechanism for rotation has a rotating shaft that is connected to the polishing brush at one end, a sliding shaft, through which the rotating shaft is inserted so that the rotating shaft can be rotated, and a holder for rotation, through which the sliding shaft is slidably inserted. The mechanism for driving the rotation generates a force for the rotating for rotating the polishing brush about the rotating shaft. The mechanism for transmitting the force for the rotation transmits the force for the rotating to the rotating shaft. The mechanism for vertically moving moves the polishing brush toward the surface of the workpiece to be polished by means of the sliding shaft. The brush unit further comprises a revolving unit that is combined with the rotating unit. The revolving unit has a mechanism for a revolution, a mechanism for driving the revolution, and a mechanism for transmitting the force for the revolution. The mechanism for the revolution rotates so as to revolve the polishing brush. The mechanism for driving the revolution generates a force for the revolution to revolve the polishing brush. The mechanism for transmitting the force for the revolution transmits the force for the revolution to the mechanism for driving the revolution. The capabilities to polish the workpiece can be tailored to the properties of the workpiece and objects to polish, since both the speed of the rotation and the speed of the revolution can be adjusted. Further, since the rotation and revolution are driven by respective forces for the driving from the separate mechanisms, the loads that are applied to the mechanisms are small, so that any troubles caused to the brush unit by an overload are reduced.

The second aspect of the present invention relates to the brush unit of the first aspect, wherein the rotating unit further comprises a mechanism for adjusting brush feed that can adjust the brush feed to force the polishing brush against the workpiece. Thus, if the bristles of the polishing brush become shorter as the polishing operation proceeds, a predetermined brush feed can be set. Here the words "brush feed" mean the magnitude necessary to force the bristles against the workpiece after the tips of the bristles contact the workpiece.

The third aspect of the present invention relates to the brush unit of the second aspect, wherein the revolving unit comprises a disc-shaped revolving plate that is located at an outer side of the center of the brush unit and a mechanism for controlling an angle to swing. The revolving plate engages the mechanism for rotation to allow the mechanism for rotation to swing. The mechanism for controlling the angle to swing controls the angle that the mechanism for rotation swings. By this configuration the polishing brush rotates about itself and revolves about the center of the revolution of the mechanism for the revolution. That is, it moves as in the planetary motion. A mechanism for driving the rotation is held to rotate about an axis that is parallel to the rotating shaft. The mechanism for driving the rotation is connected to the mechanism for controlling the angle to swing. Thus no cables of the mechanism for driving the rotation get entangled because of the revolution.

The fourth aspect of the present invention relates to the brush unit of the first or second aspect, wherein the rotating unit comprises a plurality of the polishing brushes that are fixed to respective secondary rotating shafts at their ends. The other ends of the secondary rotating shafts are combined with a secondary mechanism for transmitting the force for the rotation that transmits the force for the rotating from the end of the rotating shaft. The plurality of polishing brushes are connected to the rotating shaft. The holder for rotation is held by the mechanism for the revolution so that the axial center of the mechanism for the revolution is consistent with the axial center of the rotating shaft. Since the plurality of polishing brushes concurrently move as in the planetary motions, the capabilities to polish the workpiece are high. Since the axial center of the mechanism for the revolution is consistent with the axial center of the rotating shaft, a load that is applied to the mechanism for the revolution is reduced. Thus possible troubles that can be caused to the brush unit by an overload can be prevented.

The fifth aspect of the present invention relates to the brush unit of any of the first to fourth aspects, wherein the polishing brush is a segmented brush that holds a plurality of polishing tools by a tool for fixing the bristles. The polishing tools are made by bundling a plurality of bristles and fixing one end of the bundle to the tool for fixing the bristles. Since only the polishing tools have to be replaced if the bristles are worn as the polishing operation proceeds, a brush unit with easy maintenance can be provided.

The sixth aspect of the present invention relates to the brush unit of any of the first to fifth aspects, wherein the bristles are made of a monofilament that is made from a nylon resin that includes abrasive grains. The grain sizes are F54 to F240 or #240 to #1000. Since the bristles are made from the nylon resin, a workpiece can be polished to be very smooth, or without needlessly scratching the surface of the workpiece. Further, since the bristles contain abrasive grains of the above grain sizes, the capability that is required for polishing the workpiece can be obtained.

The seventh aspect of the present invention relates to a device for brush-polishing that comprises the brush unit of any of the first to sixth aspects and a mechanism for transporting the workpiece that transports the workpiece under the polishing brush. The mechanism for transporting the workpiece is a turntable that has areas for placing the workpiece. It intermittently and horizontally turns to transport the workpiece under the polishing brush. The areas for placing the workpiece are arranged at constant intervals on the turntable. The turntable is intermittently turned in accordance with the number of areas for placing the workpiece so that the workpiece is continuously polished.

The eighth aspect of the present invention relates to a device for brush-polishing that comprises the brush unit of any of the first to sixth aspects and a mechanism for transporting the workpiece that transports the workpiece under the polishing brush. The mechanism for transporting the workpiece is a conveyor belt that continuously and linearly transports the workpiece under the polishing brush. Since the workpiece contacts and passes through the polishing brush that moves as in the planetary motion, the entire surface of the workpiece is continuously polished.

The ninth and tenth aspects of the present invention relate to a system for brush-polishing that polishes both a first surface, and a second surface that is opposite the first surface, of the workpiece. The ninth aspect relates to the system for brush-polishing that comprises a first device for brush-polishing that polishes the first surface, which device is defined in the eighth aspect, a second device for brush-polishing that polishes the second surface, which device is defined in the eighth aspect, and an intermediate mechanism for transporting the workpiece that transports the workpiece from the first device for brush-polishing to the second device for brush-polishing. It also comprises a mechanism for turning over the workpiece at the end of the mechanism for transporting the workpiece in a direction that the workpiece is transported. The tenth aspect relates to the system for brush-polishing that comprises a first brush unit that polishes the first surface, which unit is defined in any of the first to sixth aspects, a second brush unit that polishes the second surface, which unit is defined in any of the first to sixth aspects, a mechanism for transporting the workpiece that has the areas for placing the workpiece and intermittently turns to transport the workpiece under the polishing brush, and a mechanism for turning over the workpiece that is located between the first brush unit and the second brush unit on the path of the workpiece. By these configurations both surfaces of the workpiece can be continuously polished.

The eleventh aspect of the present invention relates to a method for brush-polishing that uses the brush unit or the device for brush-polishing of any of the first to eighth aspects. The method comprises the steps of rotating the polishing brush, revolving the polishing brush, polishing a surface of a workpiece to be polished by contacting the polishing brush that rotates and revolves with the workpiece, and separately adjusting the speed of the rotation and the speed of the revolution of the polishing brush. By increasing the speed of the rotation of the polishing brush the capability for polishing is enhanced. By increasing the speed of the revolution, which is the speed that the polishing brush revolves, the rate that the polishing brush covers the surface of the workpiece is enhanced. That is, the entire surface of the workpiece can be uniformly and evenly polished. By separately adjusting the speed of the rotation and the speed of the revolution the workpiece can be effectively polished.

The basic Japanese patent application, No. 2013-020004, filed Feb. 5, 2013, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BRIEF EXPLANATION OF THE DRAWINGS

FIG. 1(A) is a front view. FIG. 1(B) is a view taken along the line B-B in FIG. 1(A). FIG. 1C is a view taken along the line A-A in FIG. 1(A).

FIG. 5(A) is a front view. FIG. 5(B) is a view taken along the line A-A in FIG. 5(A).

FIG. 10(A) is a cross-sectional view from the side of the device for brush-polishing that has the brush unit of the second embodiment. FIG. 10(B) is a cross-sectional view taken along the line A-A in FIG. 10(A).

FIG. 11(A) is a front view (a partially sectional view) of the device for brush-polishing that has the brush unit of the second embodiment. FIG. 11(B) is a cross-sectional view taken along the line A-A in FIG. 11(A).

BEST MODE FOR CARRYING OUT THE INVENTION

Figure 1:
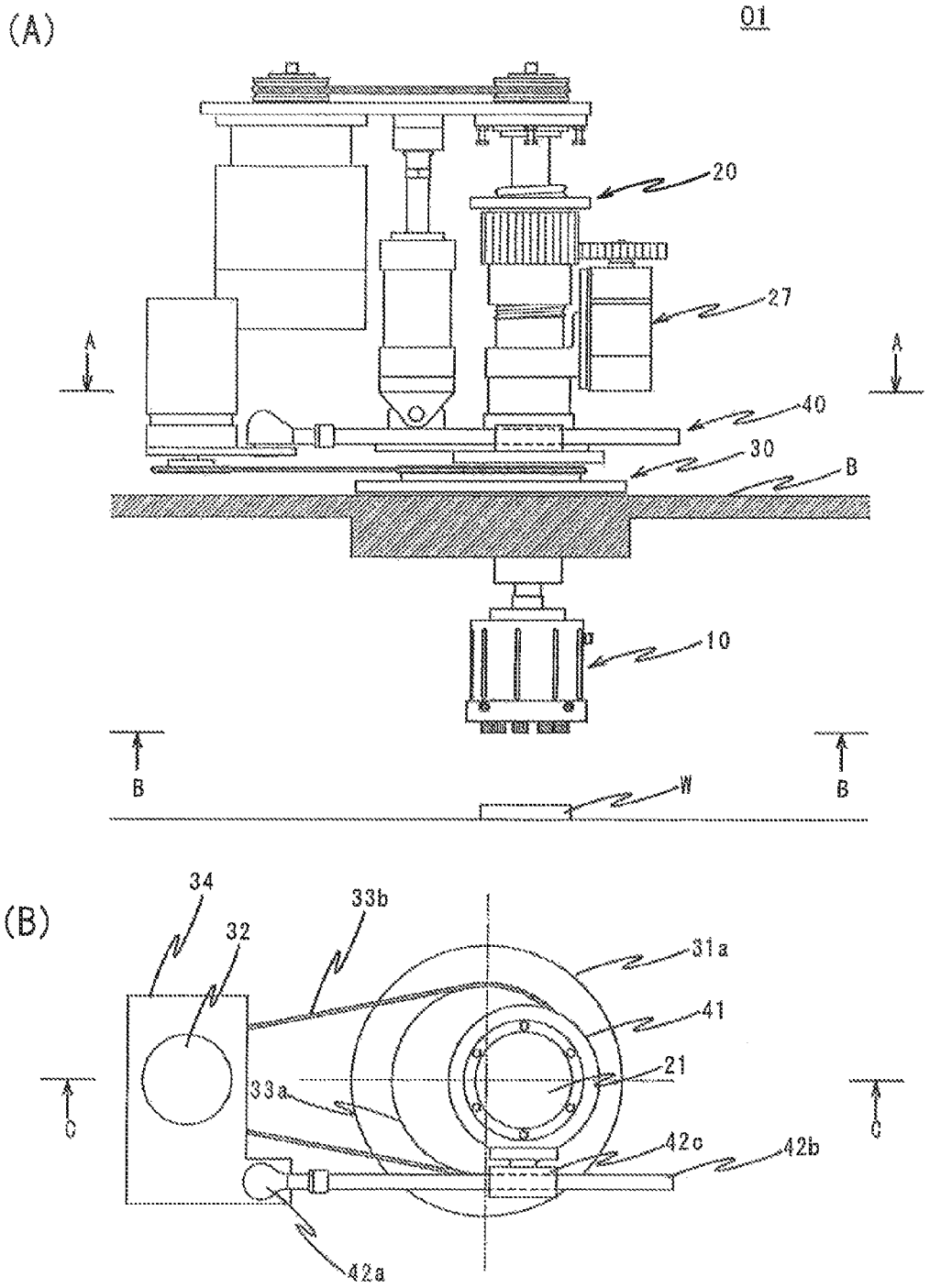
FIG. 1 is a schematic drawing of the brush unit of the first embodiment.
Figure 1:
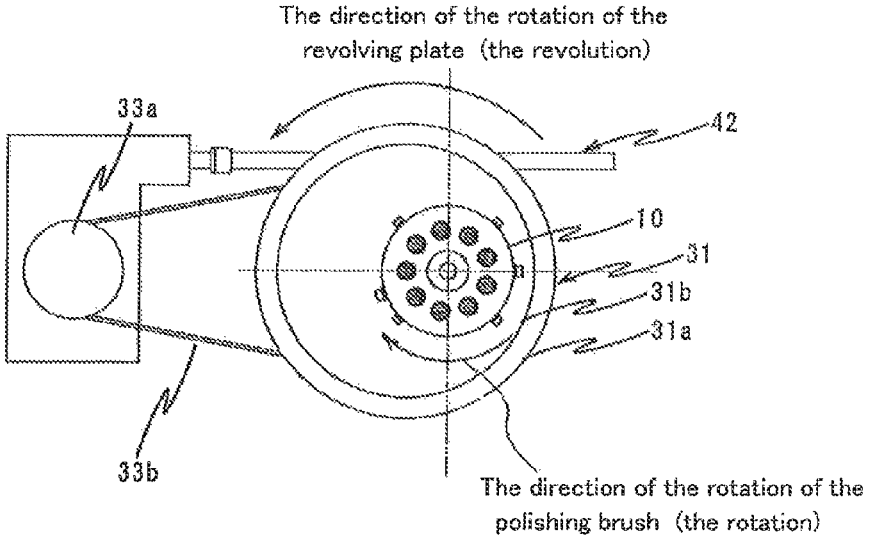

Below, an example of the device for brush-polishing of the present invention is discussed as an embodiment. In the description of the embodiment, the words "upper," "low," "left," and "right" mean the directions in the drawings, unless otherwise indicated.

A Brush Unit of a First Embodiment

As in FIGS. 1 to 4, the brush unit 01 of a first embodiment comprises a polishing brush 10, a rotating unit 20, a revolving unit 30, and a connecting unit 40.

The rotating unit 20 has a mechanism 21 for rotation that is connected to the polishing brush 10, a mechanism 22 for driving the rotation that generates a force for the driving (a force for the rotating) for rotating (for example, horizontally rotating) the polishing brush 10, a mechanism 23 for transmitting the force for the rotation that transmits the force for the rotating to the mechanism 21 for rotation, and a mechanism 26 for vertically moving that lowers the polishing brush 10 toward a workpiece W.

Figure 2:
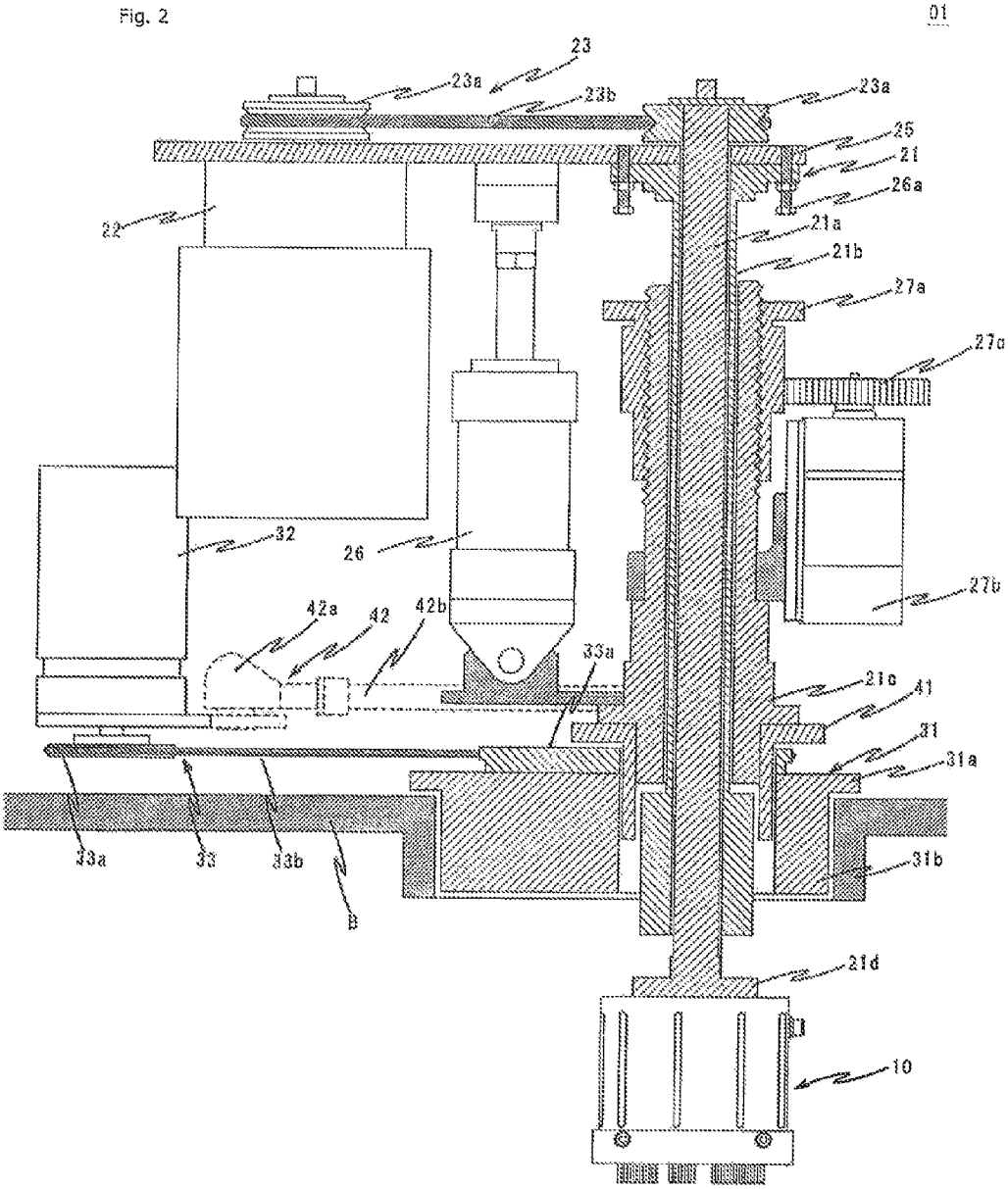
FIG. 2 is a drawing (a partially sectional view) of the brush unit of the first embodiment.
Figure 3:
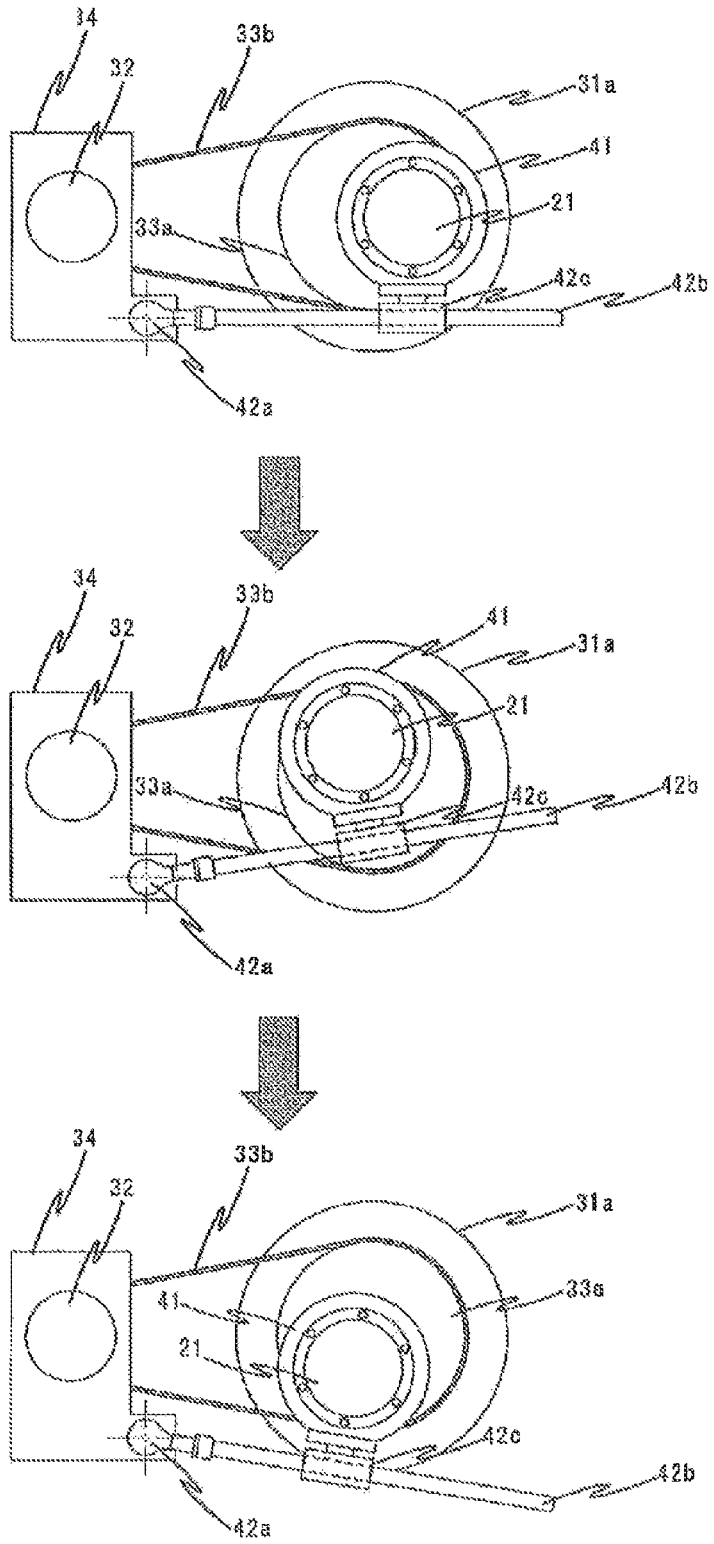
FIG. 3 is a schematic drawing illustrating the operation of the mechanism for controlling the angle to swing in the brush unit of the first embodiment.

As in FIG. 2, the mechanism 21 for rotation has a rotating shaft 21*a* that is approximately a cylindrical column, a sliding shaft 21*b* that is approximately cylindrical and receives the rotating shaft 21*a* so that it can be rotated, and a holder for rotation 21*c* that has a cylindrical hollow in which the sliding shaft 21*b* is inserted so as to slide up and down. A member 21*d* for holding the polishing brush is fixed to the lower end of the rotating shaft 21*a*. By fixing the polishing brush 10 to the member 21*d* for holding the polishing brush by a bolt, etc., the polishing brush 10 is connected to the rotating shaft 21*a*.

The mechanism 22 for driving the rotation in the present embodiment is a rotary motor. The mechanism 23 for transmitting the force for the rotation in the present embodiment is a combination of pulleys 23*a* and a V-belt 23*b*. The rotary shaft of the rotary motor and the rotating shaft 21*a* are equipped with respective pulleys 23*a* at their upper ends so that the pulleys 23*a* are linked by the endless V-belt 23*b*. By this configuration the operation of the mechanism 22 for driving the rotation drives the rotating shaft 21*a* to rotate about the axial center of it. Thus the polishing brush 10 that is connected to the rotating shaft 21*a* rotates. The mechanism for transmitting the force for the rotation is not limited to the above structure, but may be any known mechanism for transmitting a force, such as a combination of a chain and sprockets, or a train of gears.

The sliding shaft 21*b*, the mechanism 22 for driving the rotation, and the mechanism 26 for vertically moving, are fixed to a vertically-moving plate 25. Since the vertically-moving plate 25 vertically moves by the operation of the mechanism 26 for vertically moving, the rotating shaft 21*a* vertically moves in conjunction with the sliding shaft 21*b*. That is, the polishing brush 10 that is connected to the lower end of the rotating shaft 21*a* can be vertically moved by the operation of the mechanism 26 for vertically moving.

A lower limiter 26*a* is connected to the vertically-moving plate 25. When the vertically-moving plate 25 is lowered by the operation of the mechanism 26 for vertically moving, the lower limiter 26*a* bumps the upper surface of the holder for rotation 21*c* or a member 27*a* for adjustment. The member 27*a* is discussed below. So the lower limiter 26*a* is a member to prevent the vertically-moving plate 25 from being lowered beyond a predetermined distance. In the present invention it is a bolt, the length of which can be adjusted by a nut.

The mechanism 26 for vertically moving can use any structure if it can vertically move the vertically-moving plate 25. For example, any known structure such as a cylinder that is operated by hydraulic pressure, or air pressure, or electricity, an electric actuator that includes a ball screw or a belt, or a combination of a rack and pinion, can be used. In the present embodiment a cylinder that is driven by air pressure (an air cylinder) is used.

If the distance to lower the polishing brush 10 needs to precisely be adjusted, a mechanism 27 for adjusting the brush feed may be further provided. For example, as discussed below, the bristles 14*a* may be so worn that they become short as the polishing proceeds. The distance to be lowered of the polishing brush 10 that was initially set may cause an insufficient brush feed. For such a case the mechanism 27 for adjusting the brush feed can be used. In this embodiment it has a member 27*a* for adjustment wherein a female thread is formed on the inner surface and teeth are formed on the outer surface. It also has a mechanism 27*b* for moving the member for adjustment that rotates the member 27*a* for adjustment (in this embodiment a motor for setting an angle of the rotating shaft). It also has a mechanism 27*c* for transmitting a force for the adjustment that transmits a force for the operation (a force for the adjustment) of the mechanism 27*b* for moving the member for adjustment to the member 27*a* for adjustment. The mechanism 27*c* for transmitting the force for the adjustment in the present invention is a combination of teeth on the member 27*a* for adjustment and a gear that engages the teeth. It may be other mechanisms for transmitting a force, such as a V-belt and pulleys, and a chain and sprockets. A male thread is formed on the upper part of the holder for rotation 21*c* to engage the female thread of the member 27*a* for adjustment. The member 27*a* for adjustment can be screwed on the upper part of the holder for rotation 21*c*. The mechanism 27*b* for moving the member for adjustment is connected to a mechanism 27*c* for transmitting the force for the adjustment. The mechanism 27*c* for transmitting the force for the adjustment is located so that the teeth of the member 27*a* for adjustment engage the teeth of the mechanism 27*c* for transmitting the force for the adjustment.

By operating the mechanism 27*b* for moving the member for adjustment, the member 27*a* for adjustment vertically moves via the mechanism 27*c* for transmitting the force for the adjustment. Next, the mechanism 26 for vertically moving is operated to lower the vertically-moving plate 25. Then the lower limiter 26*a* bumps the upper surface of the member 27*a* for adjustment to stop the vertically-moving plate 25. Thus by adjusting the angle of the rotation of the mechanism 27*b* for moving the member for adjustment the position of the member 27*a* for adjustment can be adjusted. Thus the distance to be lowered of the vertically-moving plate 25, i.e., the polishing brush 10, can be precisely adjusted. The member 27*a* for adjustment may be vertically moved after the vertically-moving plate 25 is lowered. The lowering of the vertically-moving plate 25 may be stopped just before the lower limiter 26*a* bumps the upper surface of the member 27*a* for adjustment.

The structure of the mechanism 27 for adjusting the brush feed is not limited to the above. Any known means, such as a servo-cylinder and a ball screw, may be used in so far as it can precisely adjust the distance to be lowered of the polishing brush 10.

The revolving unit 30 comprises a mechanism 31 for the revolution, a mechanism 32 for driving the revolution, and a mechanism 33 for transmitting the force for the revolution. The mechanism 31 for the revolution has a disc-shaped revolving plate 31*a* and a shaft 31*b* for the revolution that is connected to the lower center of the revolving plate 31*a*. The mechanism 32 for driving the revolution generates a force for the driving (a force for the revolution) for horizontally rotating the mechanism 31 for the revolution (rotating about an axis that is parallel to the rotating shaft 21*a*). The mechanism 33 for transmitting the force for the revolution transmits the force for the revolution to the mechanism 31 for the revolution. The shaft 31*b* for the revolution fits a base B for the installation in the device for brush-polishing so that the shaft 31*b* can be rotated.

The mechanism 32 for driving the revolution in the present invention is a rotary motor that is fixed to a rack 34 for the mechanism for driving the revolution. The mechanism 33 for transmitting the force for the revolution in the present invention is a combination of a chain 33*b* and sprockets 33*a*. The respective sprockets 33*a* are fixed to the rotating shaft of the rotary motor and the revolving plate 31*a*, to be linked by the chain 33*b*. With this configuration, by operating the mechanism 32 for driving the revolution the shaft 31*b* for the revolution rotates about its axial center. Thus, since the shaft 31*b* for the revolution rotates about its axial center, the revolving plate 31*a* that is connected to the shaft 31*b* for the revolution rotates horizontally.

The rotating unit 20 is attached to the mechanism 31 for the revolution via the connecting unit 40, which has a connecting holder 41 and a mechanism 42 for controlling the angle to swing. The position of the rotating unit 20 to be attached is at the outer side of the mechanism 31 for the revolution and the axial center of the sprocket 33*a* that is connected to the mechanism 31 for the revolution. A through hole is formed at the position of the rotating unit 20 that is to be attached. The connecting holder 41, which is cylindrical with a flange at the upper part, is fitted to the through hole so that the holder can be rotated. A flange is formed on the holder for rotation 21*c*. By fixing the flange to the flange of the connecting holder 41 by a bolt the mechanism 21 for rotation fits into the mechanism 31 for the revolution so that the mechanism 21 can be rotated. In this way the rotating unit 20 is combined with the revolving unit 30.

The mechanism 42 for controlling the angle to swing controls the swing of the rotating unit 20 when the revolving plate 31*a* rotates. In the present embodiment as in FIG. 3, which shows the figure taken along the line A-A in FIG. 1(A), the mechanism 42 for controlling the angle to swing has a member 42*a* for the revolution, a connecting member 42*b*, and a sliding holder 42*c*. The member 42*a* for the revolution is attached to the rack 34 for the mechanism for driving the revolution so as to horizontally swing about a supporting point (the intersection of the dotted lines in the figure). The connecting member 42*b* is a cylindrical bar that is connected to the member 42*a* for the revolution. The sliding holder 42*c*, to which the connecting member 42*b* is slidably inserted, is fixed to the connecting holder 41. When the rotating unit 20 revolves in the sequence as indicated by the arrows in the figure, in conjunction with it the connecting member 42*b* swings about the supporting point. The connecting member 42*b* is inserted into the sliding holder 42*c* that is fixed to the connecting holder 41, which is fixed to the rotating unit 20. It fits into the revolving plate 31*a* so that it can be rotated. Thus the sliding holder 42*c* is at all times located by the connecting member 42*b* in the lower part in the figure. Thus the swing caused by the revolution of the rotating unit 20 is small because of the function of the mechanism 42 for controlling the angle to swing, so that no cables of the mechanism 22 for driving the rotation get entangled.

Figure 4:
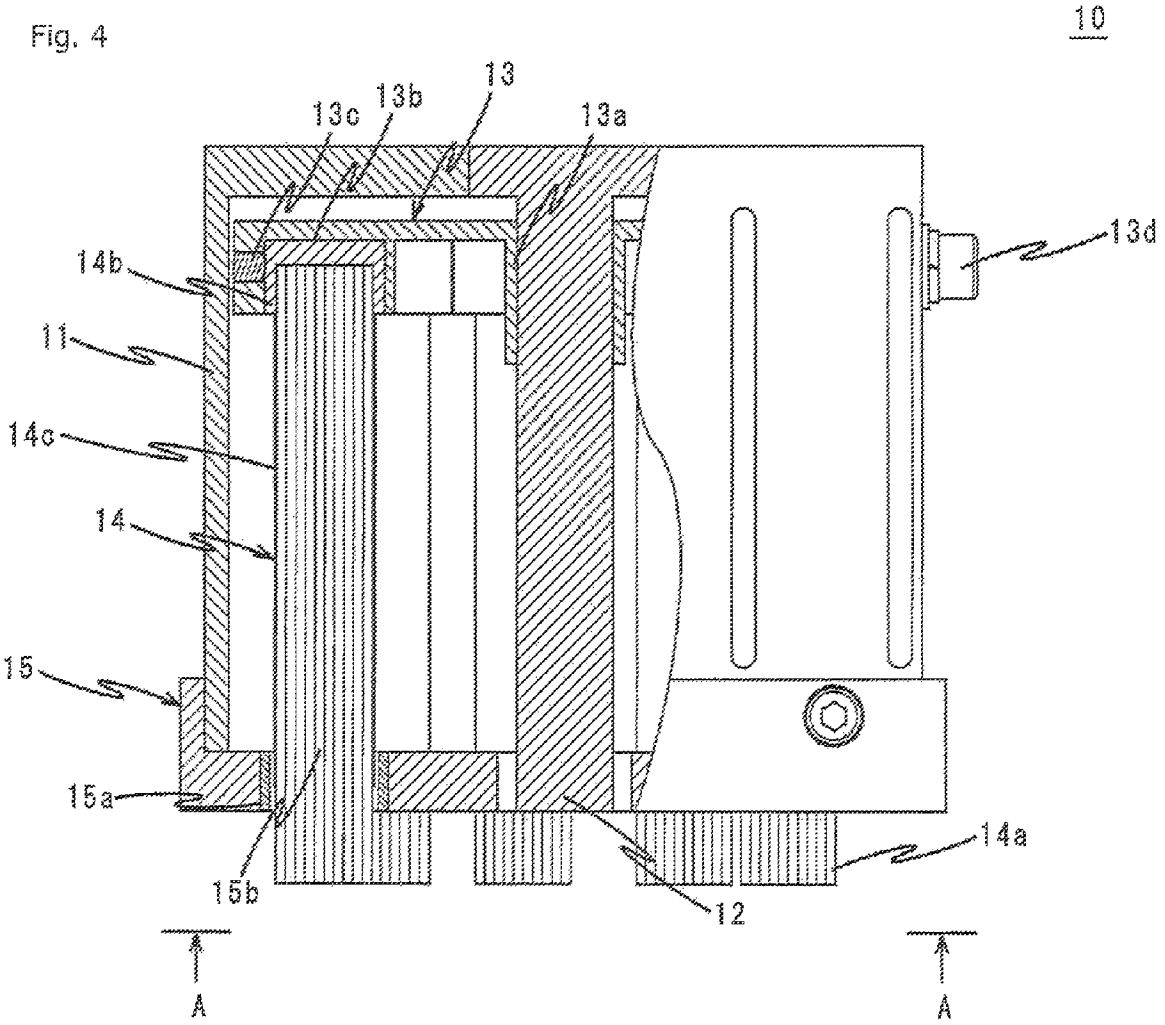
FIG. 4 is a drawing of the polishing brush that is used in the brush unit of the first embodiment.

As in FIG. 4, the polishing brush 10 comprises a rotating member 11, a sliding shaft 12, a member 13 for attaching the polishing tools, polishing tools 14, and a member 15 for supporting the polishing tools. The rotating member 11 is a cylinder with a cover on which the member 21*d* for holding the polishing brush of the rotating unit 20 is fixed. The sliding shaft 12 is a cylindrical column that is suspended at the center of the rotating member 11. The member 13 for attaching the polishing tools is slidably attached inside the rotating member 11 so that the sliding shaft 12 is inserted into a brush 13*a* that is formed at the center of the member 13 for attaching the polishing tools. The polishing tools 14 are fixed to the member 13 for attaching the polishing tools to their respective ends. The member 15 for supporting the polishing tools is detachably attached to a lower opening of the rotating member 11.

The polishing tools 14 are manufactured by bundling a plurality of bristles 14*a* that have the capability to polish, and that have their ends inserted into a hole of a holder 14*b* for the bristles to have them be bound. The bristles 14*a* are made of a round resin-made monofilament that contains abrasive grains. The resin may be a polyester or a polyamide. Examples of the polyester include polyethylene naphthalate, polyethylene terephthalate, polymethylene terephthalate, polytetramethylene terephthalate, polypropylene terephthalate, polymethylene naphthalate, polytetramethylene naphthalate, polypropylene naphthalate, and a copolymerized polyester that consists primarily of these polyesters. Examples of the polyamide includes a nylon ("n-nylon" that is synthesized by a polycondensation reaction or an "n, m-nylon" that is synthesized by a co-polycondensation reaction) and a wholly aromatic polyamide (aramid). The resin may be arbitrarily selected based on the stiffness of the bristles 14*a*, the capabilities to contain the abrasive grains, the cost, etc. In the present embodiment a polyamide is selected. By selecting that polyamide the bristles 14*a* can have both an appropriate stiffness and an appropriate flexibility.

The abrasive grains may be arbitrarily selected from alumina-based abrasive grains (alundum), silicon carbide-based abrasive grains (carborundum), alumina zirconia abrasive grains, diamond abrasive grains, CBN abrasive grains, etc., based on the properties of the workpiece W, the purposes of processing, etc. In the present embodiment silicon carbide-based abrasive grains are selected. The grain sizes of the abrasive grains may be arbitrarily selected from those of F54 to F240 and #240 to #1000 (specified by Japanese Industrial Standards R6001). If the grain sizes are too small, the capabilities to polish the workpiece by the bristles 14*a* would be insufficient. If the grain sizes are too large, the capabilities to hold the abrasive grains would be reduced so that the abrasive grains would drop from the bristles 14*a*. For example, to polish the corners of multiple holes formed in the valve plate (see FIG. 7) (an R beveling process), which is discussed below, it is preferable to select the grain sizes of those from F80 to F180.

The bristles 14*a* are manufactured by mixing the abrasive grains with the molten resin for the monofilament and then spinning the monofilament of the mixture. Since the abrasive grains are exposed on the surface to polish the workpiece W, the capabilities to polish the workpiece are enhanced. 10 to 40 parts by weight of the abrasive grains are preferably contained in 100 parts by weight of the resin. If the amount of the abrasive grains were too little, the capabilities to polish the workpiece would be insufficient. If the amount of the abrasive grains were too great, the strength of the bristles 14*a* would decrease, so that the bristles 14*a* would be easily broken.

If the diameter of the bristles 14*a* were too small, the stiffness would be too low, so that the capability for polishing would be insufficient. If the diameter of the bristles 14*a* were too big, the flexibility would be too low, so that the bristles 14*a* would be easily broken. Thus the diameter of the bristles 14*a* is preferably in a range of 0.4-1.0 mm.

After bundling a plurality of the bristles 14*a*, one of their two respective ends is inserted into the hole of the holder 14*b* for the bristles, to bind them. In this way the polishing tool 14 is manufactured. To bundle the bristles 14*a* their outer circumference may be covered by a bundling member 14*c*. The bundling member 14*c* may be made of resins (for example, a rubber, a silicon rubber, or polyvinyl chloride). Since the bristles 14*a* are bundled by the bundling member 14*c*, the bristles 14*a* are prevented from being excessively deformed when polishing. Thus the capability for polishing can be prevented from deteriorating due to excessive deformation. As the front ends of the bristles 14*a* are worn by polishing, the bundling member 14*c* is gradually broken or worn. Thus the tips of the bristles 14*a* are always exposed so that the capability for polishing can be maintained.

A plurality of fitting holes 13*b* (nine holes in the present embodiment) are formed at constant intervals in a circle with the same center as that of the member 13 for attaching the polishing tools. The fitting holes 13*b* are used to detachably fit the polishing tools 14 to them. Magnets (not shown) are provided on the fitting faces (the insides) of the fitting holes 13*b*. When the bottom of the holder 14*b* for the bristles of the polishing tools 14 is inserted into the fitting hole 13*b*, the magnet attracts and holds the holder 14*b* for the bristles. Then by tightening the bolt 13*c* for fixing the polishing tools the polishing tools 14 are fixed to the member 13 for attaching the polishing tools.

A threaded hole is formed in the member 13 for attaching the polishing tools. In the side of the rotating member a longitudinally-elongated opening is formed so that no head of a fixing bolt 13*d* can pass through it. Only the threaded portion can do so. By tightening the fixing bolt 13*d* that is inserted into the opening and screwed in the threaded hole of the member 13 for attaching the polishing tools, the member 13 for attaching the polishing tools is fixed to the rotating member 11. A brush 15*a* fits into the member 15 for supporting the polishing tools. In the brush 15*a* a hole 15*b* for the insertion is formed so that the bristles 14*a* are inserted into it. The hole 15*b* for the insertion controls the deformation of the bristles 14*a* when the bristles 14*a* are pressed against the workpiece W to polish it. Thus deteriorating the capability for polishing by the deformation can be prevented. By loosening the fixing bolt 13*d* to vertically move the member 13 for attaching the polishing tools, the tips of the bristles 14*a* are lowered by a predetermined distance from the outer surface of the member 15 for supporting the polishing tools. That is, they extend toward the workpiece. Thereafter, by again tightening the fixing bolt 13*d* to fix the member 13 for attaching the polishing tools to the rotating member 11, the distance that the bristles 14*a* are extended can be adjusted. The member 13 for attaching the polishing tools is smoothly and vertically moved along the sliding shaft 12 that is inserted into the brush 13*a* that is provided to the member 13 for attaching the polishing tools. If the bristles 14*a* become too short, the distance they extend from the member 15 for supporting the polishing tools can be adjusted to be a predetermined distance by lowering the member 13 for attaching the polishing tools as discussed above. If the bristles 14*a* become shorter, the polishing tools 14 are removed from the member 13 for attaching the polishing tools by loosening the bolt 13*c* for fixing the polishing tools and replacing them with new polishing tools 14. Then the bolt 13*c* for fixing the polishing tools is tightened. Then the distance that the bristles 14*a* extend is adjusted as discussed above, so that the replacement of the polishing tools 14 is completed.

When the workpiece W is polished by the brush unit 01 that is configured as above, first the mechanism 26 for vertically moving lowers the polishing brush 10 to the height where the tips of the bristles 14*a* are at the height of the surface of the workpiece W to be polished. Then the mechanism 26 further lowers the polishing brush 10 by a predetermined brush feed. Next, the mechanism 22 for driving the rotation and the mechanism 32 for driving the revolution are operated. Thus as in FIG. 1(B) the polishing brush 10 rotates (the polishing brush 10 itself rotates) and revolves (the polishing brush 10 revolves by the rotation of the revolving plate 31*a*), that is, moves as in the planetary motion. In these operations, the sequences to operate the mechanism 22 for driving the rotation and the mechanism 32 for driving the revolution and to operate the mechanism 26 for vertically moving may be altered. By contacting the workpiece W with the polishing brush 10 that moves as in the planetary motion the workpiece W is polished. The brush unit of the present embodiment polishes the entire workpiece more uniformly and in less time than does a brush unit that polishes a workpiece only by a rotation. Incidentally, the direction of the rotation and the direction of the revolution are preferably opposite each other, as indicated by the arrows in FIG. 1(B).

Since the rotation and revolution of the polishing brush 10 are driven by the respective driving mechanisms, the speed of the rotation and the speed of the revolution can be separately set based on the properties of the workpiece W, the purposes to process, etc. If the speed of the rotation increases, the capability for polishing is enhanced. If the speed of the revolution increases, a wide area of the workpiece is uniformly and evenly polished. In the present embodiment both the mechanism 22 for driving the rotation and the mechanism 32 for driving the revolution are rotary motors. Thus the speed of the rotation and the speed of the revolution can be easily adjusted by using an inverter or the like.

The polishing brush 10 is not limited to the above configuration. For example, a plurality of the bristles 14*a* may be fixed to the member 13 for attaching the polishing tools or the member 15 for supporting the polishing tools. The bristles 14*a* may be directly fixed to it. Alternatively, the bristles 14*a* are inserted into, and fixed by, a ditch-shaped member (a channel-shaped member) that has a U-shaped cross-section so that brushes are formed as a belt. Then the belt-like brushes are spirally wound from the center to the outside and fixed to the member 13 for attaching the polishing tools or the member 15 for supporting the polishing tools. Or, the belt-like brushes are circularized to form multiple circularized brushes with different diameters. Then the circularized brushes are fixed to the member 13 for attaching the polishing tools or the member 15 for supporting the polishing tools. In these configurations that use no polishing tools 14 the rotating member 11 may be just a circular plate or a cylindrical column in which a hole is formed so that the bristles 14*a* are fixed to a lower surface of the circular plate or the hole. By these configurations the polishing brush 10 can be manufactured at a low cost.

A Brush Unit of a Second Embodiment

Figure 5:
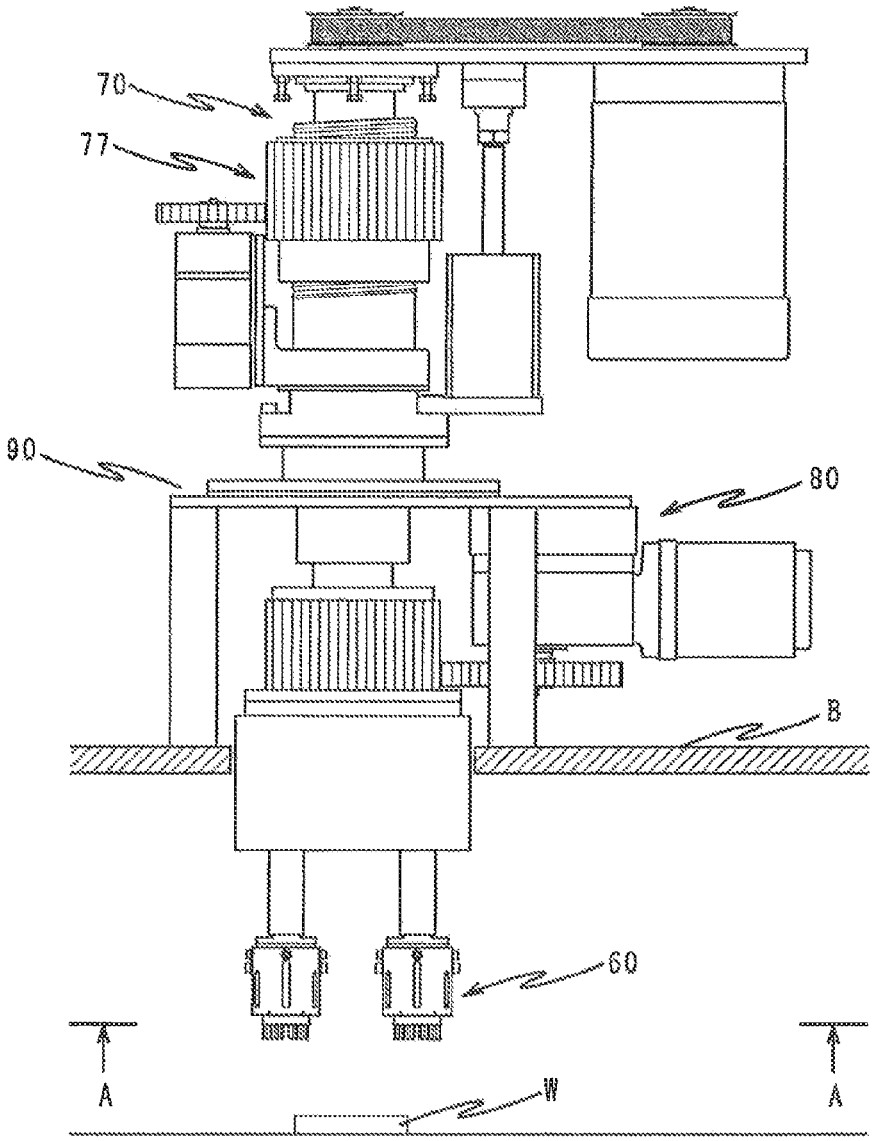
FIG. 5 is a schematic drawing of the brush unit of the second embodiment.
Figure 5:
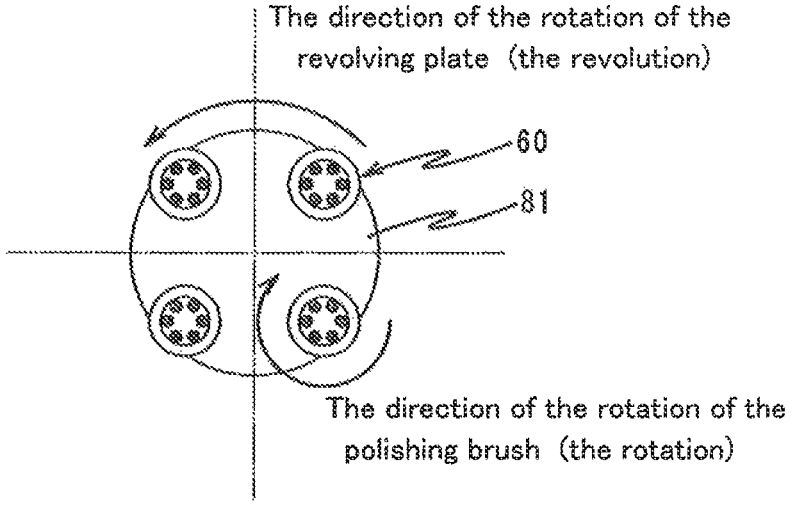
Figure 6:
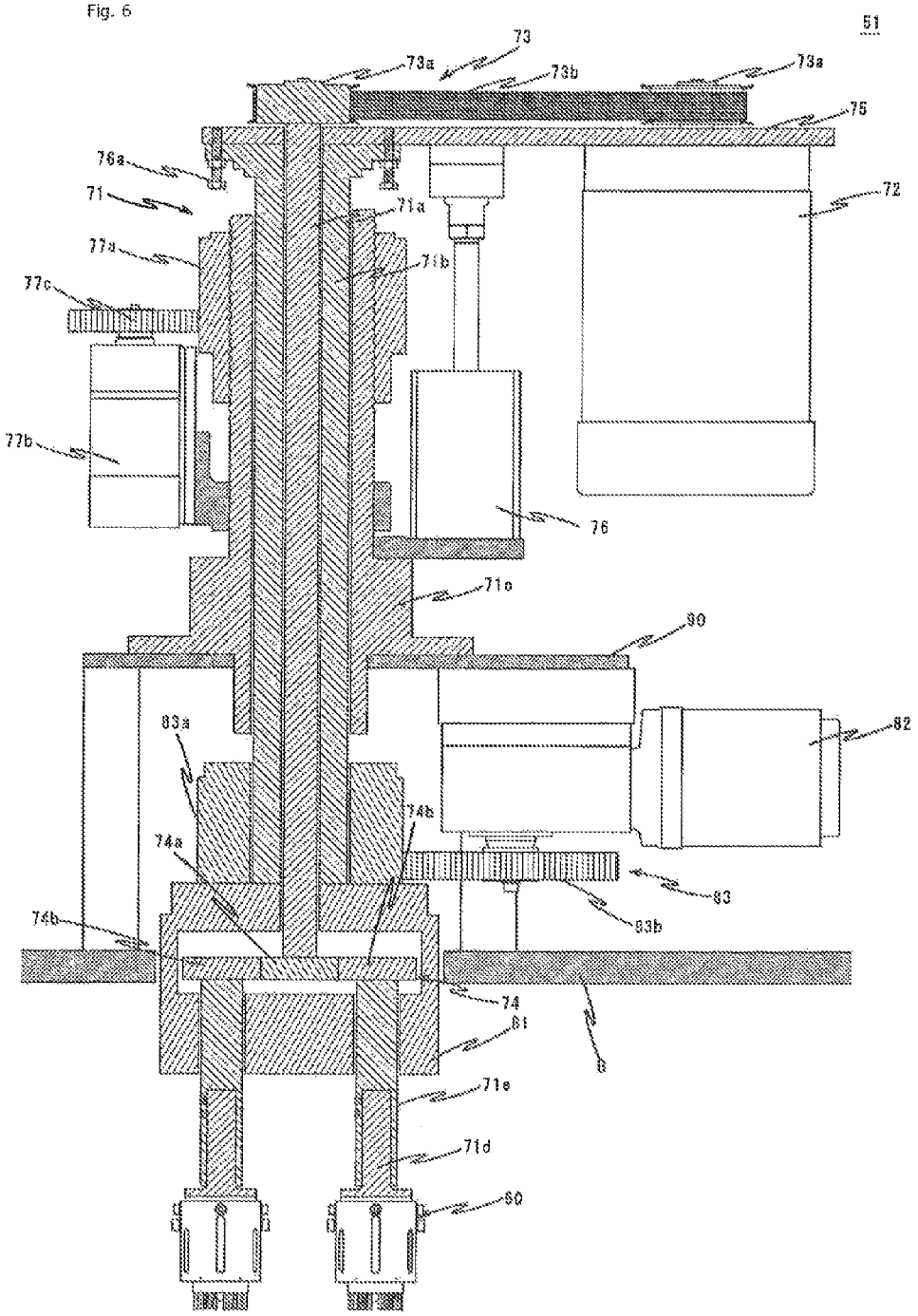
FIG. 6 is a schematic drawing (a partially sectional view) of the brush unit of the second embodiment.
Figure 7:
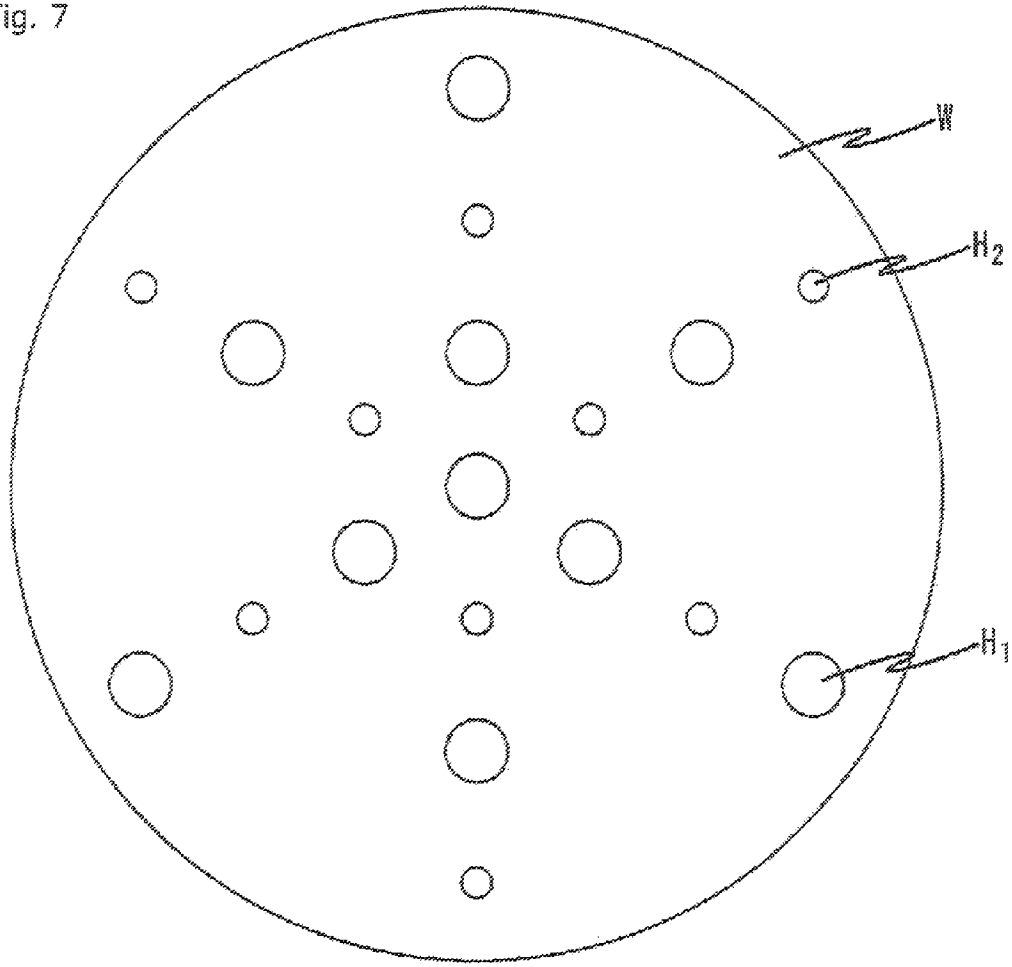
FIG. 7 is a schematic drawing of the valve plate, which is a workpiece processed in the embodiment.

Next, with reference to FIGS. 5, 6, and 7, a brush unit 51 of a second embodiment is discussed. The configuration of the second embodiment is the same as that of the first embodiment, unless otherwise indicated.

As in FIG. 5(A), the brush unit 51 of the second embodiment comprises multiple polishing brushes 60 (four brushes in the present embodiment), a rotating unit 70, a revolving unit 80, and a rack 90.

The configuration of the polishing brushes 60 is the same as that of the polishing brush 10 of the first embodiment, though there are some differences in the designs, such as their sizes and the number of polishing tools.

As in FIG. 6, the rotating unit 70 comprises a mechanism 71 for rotation, a mechanism 72 for driving the rotation, a mechanism 73 for transmitting the force for the rotation, a secondary mechanism 74 for transmitting the force for the rotation, and a mechanism 76 for vertically moving. The mechanism 71 for rotation is connected to the polishing brushes 60. The mechanism 72 for driving the rotation generates a force for the driving (a force for the rotating) for rotating the polishing brushes 60. The mechanism 73 for transmitting the force for the rotation transmits it from the mechanism 72 for driving the rotation to the mechanism 71 for rotation. The secondary mechanism 74 for transmitting the force for the rotation transmits the force for the rotating from the mechanism 71 for rotation (specifically, a rotating shaft 71*a*) to the polishing brushes 60. The mechanism 76 for vertically moving lowers the polishing brushes 60 toward the workpiece W.

The mechanism 71 for rotation has a rotating shaft 71*a*, a sliding shaft 71*b*, a holder for rotation 71*c*, and secondary rotating shafts 71*e*. The rotating shaft 71*a* is formed approximately as a cylindrical column. The sliding shaft 71*b* is formed as approximately a cylinder, into which the rotating shaft 71*a* is inserted so that it can be rotated. The holder for rotation 71*c* receives the sliding shaft 71*b* so that the sliding shaft 71*b* slides vertically. The secondary rotating shafts 71*e* are connected to the rotating shaft 71*a* via the secondary mechanism 74 for transmitting the force for the rotation. The secondary rotating shafts 71*e* are provided in accordance with the number of polishing brushes 60. Members 71*d* for holding the polishing brush are fixed to the respective lower ends of the secondary rotating shafts 71*e*. By fixing the polishing brushes 60 to the members 71*d* for holding the polishing brush by bolts, the polishing brushes 60 are connected to the respective secondary rotating shafts 71*e*.

In the present embodiment the mechanism 72 for driving the rotation is a rotary motor. The mechanism 73 for transmitting the force for the rotation is a combination of timing pulleys 73*a* and a timing belt 73*b*. The timing pulleys 73*a* are fixed to the respective upper ends of the rotating shaft of the rotary motor and the rotating shaft 71*a*, to be linked by the endless timing belt 73*b*.

The secondary mechanism 74 for transmitting the force for the rotation is a set of gears that can engage each other. The gear 74*a* at the side of the rotating shaft is fixed to the lower end of the rotating shaft 71*a*. The gears 74*b* at the side of the secondary rotating shafts are fixed to the upper ends of the secondary rotating shafts 71*e*. The secondary rotating shafts 71*e* are arranged at uniform intervals around the rotating shaft 71*a* so that the gears 74*b* at the side of the secondary rotating shafts engage the gear 74*a* at the side of the rotating shaft. With this configuration, when the mechanism 72 for driving the rotation is operated, the rotating shaft 71*a* rotates about its central axis. The secondary rotating shafts 71*e* rotate to follow the rotation of the rotating shaft 71*a*. Thus all the polishing brushes 60 that are connected to the rotating shaft 71*a* rotate. Incidentally, the secondary mechanism for transmitting the force for the rotating is not limited to the above structure. It may be any mechanism for transmitting one force to multiple members, such as a combination of multiple V-belts and pulleys, and a combination of multiple chains and sprockets.

The sliding shaft 71*b*, the mechanism 72 for driving the rotation, and the mechanism 73 for transmitting the force for the rotation, are all fixed to a vertically-moving plate 75. The mechanism 76 for vertically moving that is fixed to the holder for rotation 71*c* is connected to the vertically-moving plate 75. The mechanism 76 for vertically moving is an air cylinder that is similar to the one in the first embodiment. By the operation of the mechanism 76 for vertically moving, the vertically-moving plate 75 vertically moves so that the sliding shaft 71*b* is lowered. The rotating shaft 71*a* and the secondary rotating shafts 71*e* also vertically move to follow the lowering of the sliding shaft 71*b*. Thus the operation of the mechanism 76 for vertically moving vertically moves the polishing brushes 60 that are connected to the lower ends of the secondary rotating shafts 71*e*.

The lower limiter 76*a* is provided for the same purpose as the lower limiter 26*a* of the first embodiment. A bolt, the length of which can be adjusted by a nut, is also used in the present embodiment.

If the distance to lower the polishing brushes 60 needs to be precisely adjusted, a mechanism 77 for adjusting the brush feed may be further provided like in the first embodiment. In the present embodiment, like in the first embodiment, the mechanism 77 for adjusting the brush feed has a member 77*a* for adjustment wherein a female thread is formed on the inner surface and teeth are formed on the outer surface. It also has a mechanism 77*b* for moving the member for adjustment that rotates the member 77*a* for adjustment (in this embodiment a motor for setting the angle of the rotating shaft). It also has a mechanism 77*c* for transmitting the force for the adjustment that transmits a force for the operation (a force for the adjustment) of the mechanism 77*b* for moving the member for adjustment to the member 77*a* for adjustment. The mechanism 77*c* for transmitting the force for the adjustment in the present invention is a combination of teeth on the member 77*a* for adjustment and a gear that engages the teeth. A male thread that engages a female thread of the member 77*a* for adjustment is provided on the upper portion of the holder for rotation 71*c* so that the member 77*a* for adjustment is screwed into the upper portion of the holder for rotation 71*c*. The mechanism 77*b* for moving the member for adjustment is operated with the angle of the rotation being set so that the member 77*a* for adjustment moves by a predetermined distance. Thus the distance to be lowered of the vertically-moving plate 75, i.e., the polishing brushes 60, can be precisely adjusted.

The revolving unit 80 has a mechanism 81 for the revolution, a mechanism 82 for driving the revolution, and a mechanism 83 for transmitting the force for the revolution. The mechanism 82 for driving the revolution generates a force for the driving (a force for the revolution) to horizontally rotate the mechanism 81 for the revolution. The mechanism 83 for transmitting the force for the revolution transmits it to the mechanism 81 for the revolution.

The mechanism 81 for the revolution is a cylinder. A hole is formed in the upper portion of it. The sliding shaft 71*b* is inserted into the hole so that the mechanism 81 for the revolution rotates about the sliding shaft 71*b*. Holes into which the secondary rotating shafts 71*e* are inserted so that they can be rotated are formed in the lower portion of the mechanism 81 for the revolution. In the middle of it a space to enclose the secondary mechanism 74 for transmitting the force for the rotation is formed.

The mechanism 82 for driving the revolution in the present embodiment is a rotary motor. In the present embodiment the mechanism 83 for transmitting the force for the revolution is a set of gears that engage each other. The gear 83*a*, which is located at the side of the mechanism for the revolution, is fixed to the mechanism 81 for the revolution. The gear 83*b*, which is located at the side of the mechanism for driving the revolution, is fixed to the rotating shaft of the rotary motor.

The rotating unit 70, which is equipped with the mechanism 81 for the revolution, is fixed to the rack 90 via the holder for rotation 71*c*. The rack 90 is provided on the base B for the installation inside the device for brush-polishing. The mechanism 82 for driving the revolution, to which the gear 83*b* at the side of the mechanism for driving the revolution is fixed, is fixed to the rack 90 so that the gear 83*a* at the side of the mechanism for the revolution engages with the gear 83*b* at the side of the mechanism for driving the revolution. In this way the rotating unit 70 is combined with the revolving unit 80.

When the workpiece W is polished by the brush unit 51 that is configured as above, first the mechanism 76 for vertically moving lowers the polishing brush 60 to the height where the tips of the bristles 14*a* are at the height of the surface of the workpiece W to be polished. Then the mechanism 76 further lowers the polishing brush 10 by a predetermined brush feed. Next, the mechanism 72 for driving the rotation and the mechanism 82 for driving the revolution are operated. The rotating shaft 71*a* rotates by the operation of the mechanism 72 for driving the rotation. The polishing brushes 60 rotate (horizontally rotate) to follow the rotation of the rotating shaft 71*a*. The mechanism 81 for the revolution horizontally rotates by the operation of the mechanism 82 for driving the revolution so that the polishing brushes 60 revolve about the central axis of the mechanism 81 for the revolution. Since the rotation of the rotating shaft 71*a* does not interfere with the rotation of the mechanism 81 for the revolution, as in FIG. 5(B) the polishing brushes 60 rotate (the polishing brushes 60 themselves horizontally rotate) and concurrently revolve (the polishing brushes 60 revolve by the rotation of the mechanism 81 for the revolution). That is, they move as in the planetary motion. Next, the mechanism 76 for vertically moving lowers the polishing brushes 60 to the height where the tips of the bristles are at the height of the surface of the workpiece W to be polished. Then the mechanism 76 further lowers the polishing brush 60 by a predetermined brush feed. In these operations, the sequence to operate the mechanism 72 for driving the rotation and the mechanism 82 for driving the revolution and to operate the mechanism 76 for vertically moving may be altered. By contacting the workpiece W with the polishing brush 60 that moves as in the planetary motion the workpiece W is polished. The brush unit of the present embodiment polishes the entire workpiece more uniformly and in less time than does a brush unit that polishes a workpiece only by the rotation. Incidentally, the direction of the rotation and the direction of the revolution are preferably in opposite directions, as indicated by the arrows in FIG. 5(B).

Further, the chances to contact the bristles with the workpiece W in the polishing by the brush unit 51 of the present embodiment are more than those by the brush unit 01 of the first embodiment. Thus the entire workpiece can be polished more uniformly and in less time. Further, if the diameters of the polishing tools decrease, small areas can be polished. For example, processes for rounding corners of the holes on the surface of the valve plate (see FIG. 7), which are discussed below, can be effectively carried out. The diameters of the polishing tools in the present invention are selected from those in the range of 10 to 25 mm.

Since the rotation and the revolution of the polishing brushes 60 are driven by separate driving mechanisms, the speed of the rotation and the speed of the revolution can be separately set based on the properties of the workpiece W, the purpose to process, etc., like in the first embodiment. If the speed of the rotation increases, the capability for polishing is enhanced. If the speed of the revolution increases, a wide area of the workpiece is uniformly and evenly polished. In the present embodiment both the mechanism 72 for driving the rotation and the mechanism 82 for driving the revolution are rotary motors. Thus the speed of the rotation and the speed of the revolution can be easily adjusted by using an inverter or the like.

Further, since the axial center of the rotating shaft 71*a* for rotating the plurality of polishing brushes 60 and the axial center of the revolution lay on the same line, the speed of the revolution can be increased above that of the first embodiment. By increasing the speed of the revolution the workpiece W can be further uniformly polished.

Next, a device for brush-polishing that has the brush unit of the first embodiment or the second embodiment and a system for brush-polishing that continuously polishes the surfaces of both sides of a workpiece are discussed. A device for brush-polishing that polishes a plurality of the workpieces W may be a "conveyor-type" device that linearly transports the workpieces W under the brush unit or a "turntable-type" device that transports the workpiece W under the brush unit by intermittently rotating a circular plate, on which the workpieces W are placed.

<A Device for Brush-Polishing and a System for Brush-Polishing, a Conveyor-Type>

First, an example of a conveyor-type device 101 for brush-polishing that has the brush unit is discussed. The conveyor-type device 101 for brush-polishing may have the brush unit 01 of the first embodiment or the brush unit 51 of the second embodiment. Below, the device 101 that has the brush unit 51 of the second embodiment is discussed.

Figure 8:
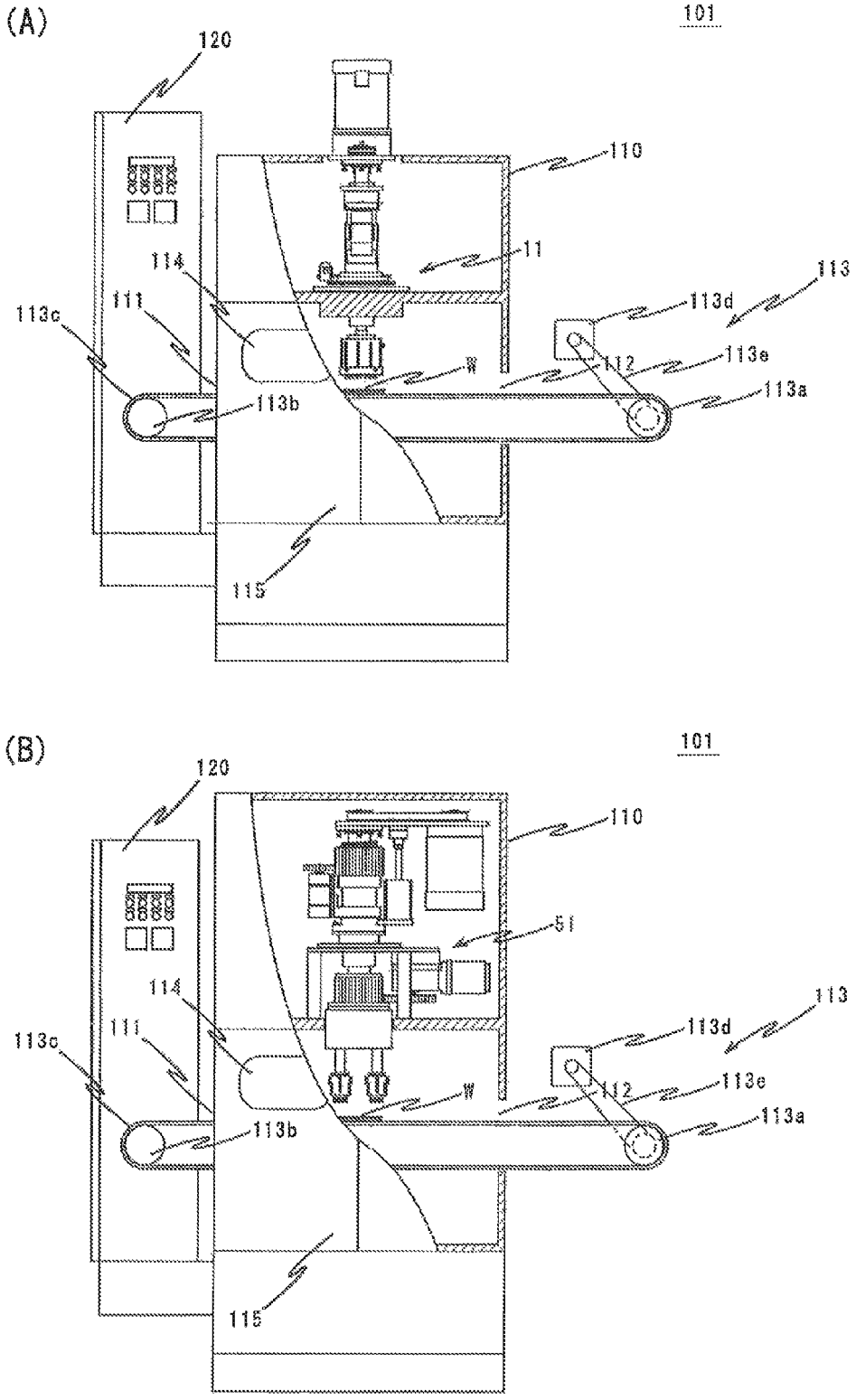
FIG. 8 is a schematic drawing of the conveyor-type device for brush-polishing.

As in FIG. 8, the device 101 for brush-polishing comprises a housing 110, a mechanism 113 for transporting the workpiece, and a controller 120. The housing 110 encloses the brush unit 51. The mechanism 113 for transporting the workpiece penetrates the housing 110 through a port 111 for loading and a port 112 for unloading that are formed on the left and right sides, respectively, of the housing 110. The controller 120 controls the operations of the brush unit 51 and the mechanism 113 for transporting the workpiece.

The mechanism 113 for transporting the workpiece carries the workpiece W in the housing 110 through the port 111 for loading (located on the left side in FIG. 8) to transport it under the brush unit 51. It carries the workpiece W out through the port 112 for unloading (located on the right side in FIG. 8) after the workpiece W has been polished by the brush unit 51. In so far as it can transport the workpiece, its structure is not limited to the above. Any known means, such as a conveyor belt, a roller conveyor, and a combination of a rack and pinion, can be used. In this embodiment a conveyor belt is used. The conveyor belt has at one end a driving roller 113*a*, and at the other end a driven roller 113*b* that freely rotates. An endless rubber belt 113*c* links the driving roller 113*a* and the driven roller 113*b*. The driving roller 113*a* is connected to a driver 113*d* for transporting (a rotary motor) via a mechanism 113*e* for transmitting a force for the driving (a V-belt and pulleys).

The conditions for polishing, such as "the speed of the rotation," "the speed of the revolution," "the brush feed," and "the speed to transport the workpiece," are input to the controller 120. In so far as the controller 120 can control the operations with the conditions to polish being input, a motion controller such as a programmable logic controller (PLC) and a digital signal processor (DSP), a personal computer, a multifunctional terminal, a smartphone, etc., can be used.

Next, a method for polishing the workpiece W by using the conveyor-type device 101 for brush-polishing is discussed. Before a polishing operation is started, the lower limiter 76*a* is adjusted so that the tips of the bristles contact the surface of the workpiece W to be polished (i.e., to be at the height of the workpiece W) when the polishing brushes 60 are lowered to be at the position where the brush feed is zero. Below this position is called the standard position for lowering.

The conditions for polishing are preliminarily input to the controller 120. Next, the workpiece W is placed on the left side of the mechanism 113 for transporting the workpiece. Then the "start operation button" of the controller 120 is pushed down at ON. The signals to operate the device 101 for brush-polishing to follow the conditions to polish that have been input to the controller 120 are sent to the brush unit 51 and the mechanism 113 for transporting the workpiece. By the signals, the mechanism 76 for vertically moving is operated so that the polishing brushes 60 are lowered to the standard position for lowering. Then the mechanism 77 for adjusting the brush feed is operated so that the polishing brushes 60 are further lowered by the "brush feed" that has been preliminarily input. Next, the mechanism 72 for driving the rotation and the mechanism 82 for driving the revolution are operated so that the polishing brushes 60 move as in the planetary motion at the predetermined speed of the rotation and speed of the revolution.

Next, the driver 113*d* for transporting is operated. Since the belt 113*c* moves as the upper face moves from the left to the right by the mechanism 113*d*, the workpiece W moves from the left to the right at the predetermined speed.

When the workpiece W moves under the polishing brushes 60 the tips of the bristles of the polishing brushes 60 contact the workpiece W so as to be pressed by it. Since the polishing brushes 60 move as in the planetary motion, the workpiece W is polished while it passes under the polishing brushes 60.

The workpiece W that has passed under the polishing brushes 60 moves further to the right to go through the port 112 for unloading and goes out of the housing 110. Thus a surface on one side of the workpiece W is polished.

By placing the workpieces W one after another on the mechanism 113 for transporting the workpiece to transport them under the polishing brushes 60 that move as in the planetary motion, a plurality of the workpieces W can be continuously polished.

Since a window 114 is provided on the front face of the housing 110, the status of the polishing can be observed.

The bristles become short as the polishing proceeds. Thus the mechanism 77 for adjusting the brush feed is operated to lower the polishing brushes 60 by the length that the bristles have been worn based on "the rate of the bristles to be worn" that is preliminarily input to the controller 120. So the brush feed of the polishing brushes 60 can be maintained at a constant value even when they have polished a plurality of the workpieces W. Thus the accuracy of the processing does not vary.

If the bristles are worn and become too short, then a door 115 that is provided at the front face of the housing 110 opens so that the polishing tools are replaced.

Figure 9:
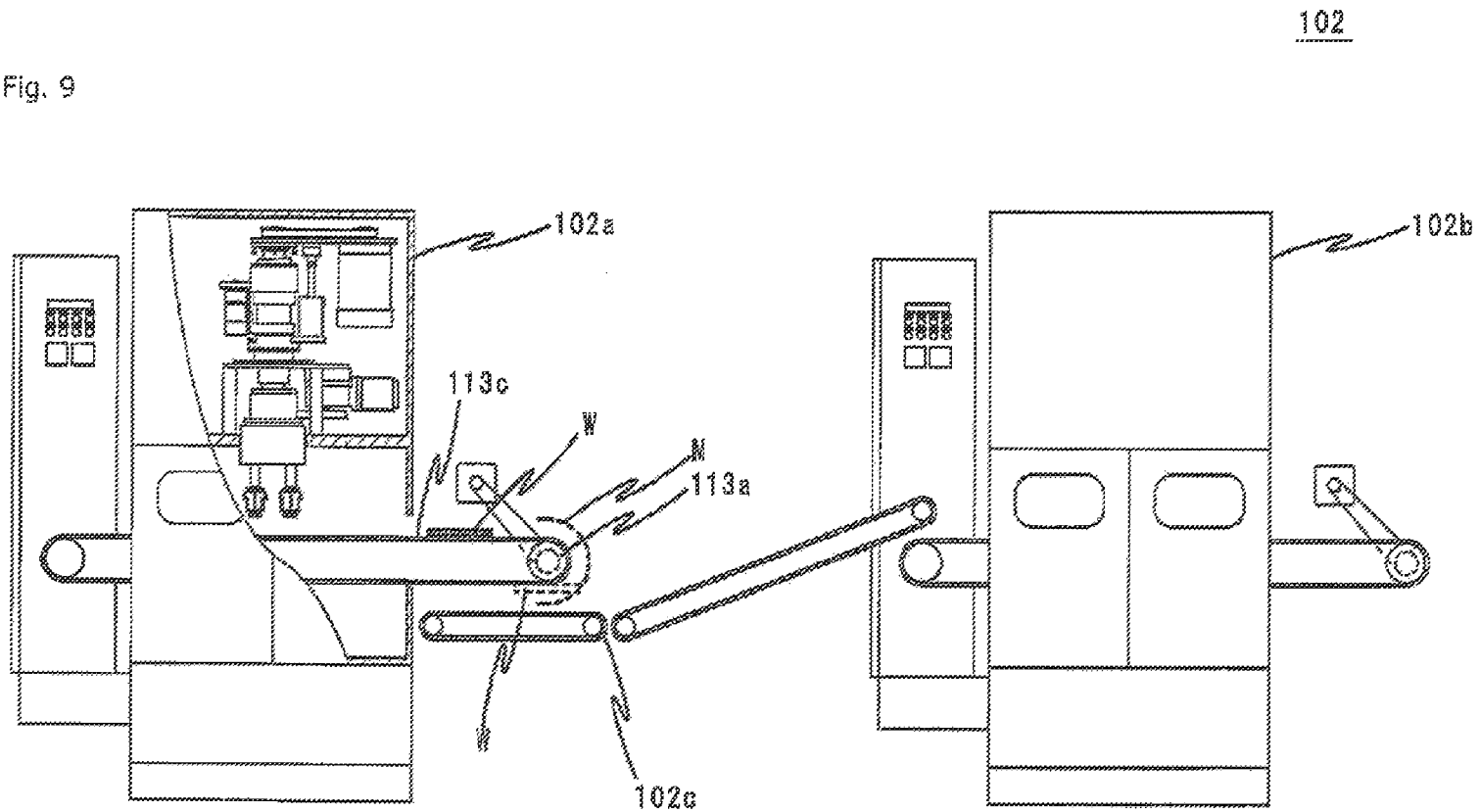
FIG. 9 is a schematic drawing (a partially sectional view) of the system for brush-polishing.

Next, the system 102 for brush-polishing that continuously polishes the first surface of the workpiece W, and the second surface, which is opposite the first surface, is discussed. As in FIG. 9, the system 102 for brush-polishing has a first device 102*a* for brush-polishing that polishes the first surface and a second device 102*b* for brush-polishing that polishes the second surface. An intermediate mechanism 102*c* for transporting the workpiece is provided between the first device 102*a* for brush-polishing and the second device 102*b* for brush-polishing so that the first device 102*a* is connected to the second device 102*b*.

Both the first device 102*a* for brush-polishing and the second device 102*b* for brush-polishing use the device 101 for brush-polishing. So the discussion about the operations, etc., of the first device 102*a* and the second device 102*b* is omitted. Some of the numbers are the same as those for the device 101 for brush-polishing, for ease of discussion.

The intermediate mechanism 102*c* for transporting the workpiece, on which the workpiece W that has been brush-polished by the first device 102*a* for brush-polishing is automatically placed, transports it to the mechanism 113 for transporting the workpiece of the second device 102*b* for brush-polishing. In so far as it transports the workpiece as above, its structure is not limited. In the present embodiment a conveyor belt is used along with the mechanism 113 for transporting the workpiece of the device 101 for brush-polishing.

The workpiece W that has been polished on the first surface by the first device 102*a* for brush-polishing must be turned over before it is placed on the second device 102*b* for brush-polishing. The mechanism for turning over the workpiece W may be a mechanical one, such as robotic arm. However, in the present embodiment a driving roller 113*a* that is located at the transporting end of the workpiece W (the right side in FIG. 9) is magnetized so that the belt 113*c* at the transporting end attracts the workpiece W (an attracting area M). The workpiece W that has been transported to the attracting area M is attracted to the belt by the magnetic force and moved to the opposite side (the lower portion in FIG. 9). At this time, the upper surface of the workpiece W is the second surface (see the dotted line in FIG. 9). When the workpiece W moves further forward to depart from the attracting area M it is released from the attraction to the belt 113*c*, as no magnetic force is then being generated. Thus it is dropped on the intermediate mechanism 102*c* for transporting the workpiece to be placed on it. The workpiece W that is turned over in this way is transported to the mechanism 113 for transporting the workpiece of the second device 102*b* for brush-polishing by the intermediate mechanism 102*c* for transporting the workpiece. The workpiece W is polished by the second device 102*b* for brush-polishing like by the first device 102*a*. Thus the second surface is polished. In this way the surfaces of both sides of the workpiece W are polished by the system 102 for brush-polishing.

<A Device for Brush-Polishing and a System for Brush-Polishing, a Turntable-Type>

Next, a device 201 for brush-polishing that uses a turntable is discussed. The device 201 for brush-polishing that uses a turntable may have the brush unit 01 of the first embodiment, or may have the brush unit 51 of the second embodiment like the conveyor-type device 101 for brush-polishing. Below, the device 201 that has the brush unit 51 of the second embodiment is discussed.

Figure 10:
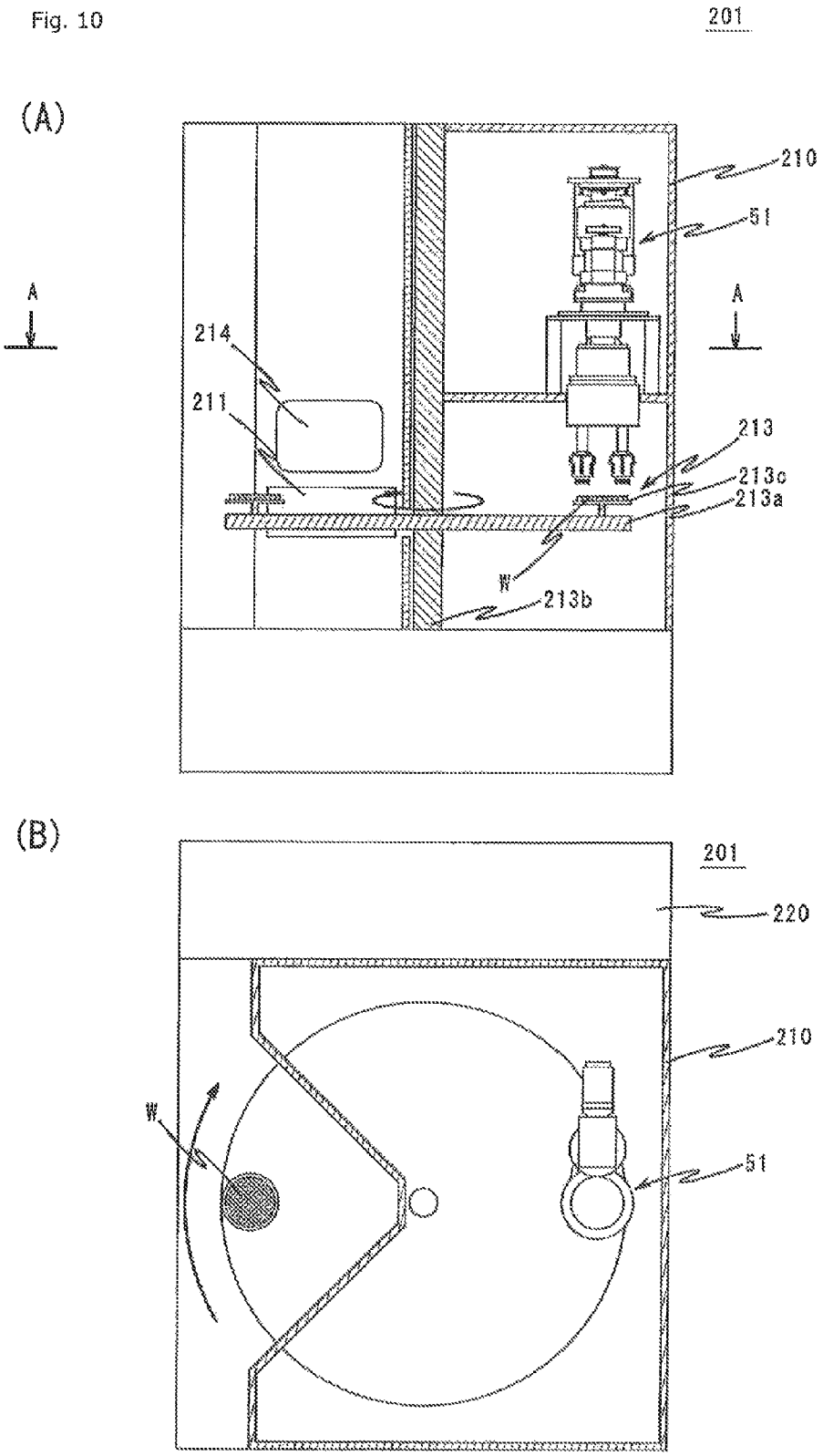
FIG. 10 is a schematic drawing of the device for brush-polishing that uses a turntable.

As in FIGS. 10 (A) and (B), the device 201 for brush-polishing comprises a housing 210, a mechanism 213 for transporting the workpiece, and a controller 220. The housing 210 encloses the brush unit 51. The mechanism 213 for transporting the workpiece transports the workpiece W under the brush unit 51. The controller 220 controls the operations of the mechanism 213 for transporting the workpiece and the brush unit 51.

The mechanism 213 for transporting the workpiece comprises a disc-shaped turntable 213*a*, a rotating shaft 213*b*, a mechanism for driving the turntable (not shown), and a plurality of portions 213*c* for placing the workpiece (two in FIG. 10). The rotating shaft 213*b* is fixed to the center of the plane of the turntable 213*a*. The mechanism for driving the turntable rotates the turntable 213*a* that is connected to the rotating shaft 213*b*. The portions 213*c* for placing the workpiece are arranged at constant intervals on the turntable 213*a*. The portions 213*c* for placing the workpiece may be configured to only place and anchor the workpiece W or to rotate it when the workpiece is polished. By polishing the workpiece W while being rotated the capabilities to polish the workpiece are enhanced.

The turntable 213*a* horizontally turns about the rotating shaft 213*b*. It is arranged so that the workpiece W is polished within the housing 210 but is loaded and unloaded outside it.

In the front wall of the housing 210 a port 211 for loading is formed so that the portion 213*c* for placing the workpiece and the workpiece W can pass through it.

The conditions for polishing, such as "the speed of the rotation," "the speed of the revolution," "the brush feed," "the rate of the bristles to be worn," and "the duration for polishing," are input in the controller 220. In so far as the controller 220 can control the operations by inputting the conditions to polish in it, a motion controller such as a programmable logic controller (PLC) and a digital signal processor (DSP), a personal computer, a multifunctional terminal, a smartphone, etc., can be used.

Next, a method for polishing the workpiece W by using the device 201 for brush-polishing that uses a turntable is discussed. Mainly discussed are the points that differ from that method by using the conveyor-type device 101 for brush-polishing, which is discussed above.

Before a polishing operation is started, the lower limiter 76*a* is adjusted so that the polishing brushes 60 are lowered to the standard position for lowering, like in the conveyor-type device 101 for brush-polishing. The conditions to polish are preliminarily input in the controller 220.

The workpiece W is placed on the portion 213*c* for placing the workpiece that is located outside the housing 210. Then the "start operation button" of the controller 220 is pushed down at ON. First, the turntable 213*a* turns by 180° about the rotating shaft 213*b* so that the workpiece W moves under the brush unit 51 and stops there.

Next, the mechanism 72 for driving the rotation and the mechanism 82 for driving the revolution are operated to follow the conditions to polish that are input to the controller 220, so that the polishing brushes 60 move as in the planetary motion. At this time if the portion 213*c* for placing the workpiece is configured to rotate, it starts to rotate. Then the mechanism 76 for vertically moving and the mechanism 77 for adjusting the brush feed are operated so that the tips of the bristles of the polishing brushes 60 are pressed against the workpiece W by the predetermined "brush feed." Thus the polishing of the workpiece W starts.

When the "duration for polishing" that has been input to the controller 220 elapses, the mechanism 76 for vertically moving is operated so that the polishing brushes 60 upwardly move, to be detached from the workpiece W. Next, the mechanism 72 for driving the rotation and the mechanism 82 for driving the revolution stop so that the planetary motion of the polishing brushes 60 stops. At this time if the portion 213*c* for placing the workpiece is configured to rotate, it also stops rotating.

Then the turntable 213*a* turns by 180° so that the workpiece W that has been polished moves outside the housing 210. In this way the surface of one side of the workpiece W is polished.

During the polishing a new workpiece W is placed on the portion 213*c* for placing the workpiece that is located outside the housing 210. Thus continuous polishing can be carried out.

Since a window 214 is provided on the front face of the housing 210, the status of the polishing can be observed.

Figure 11:
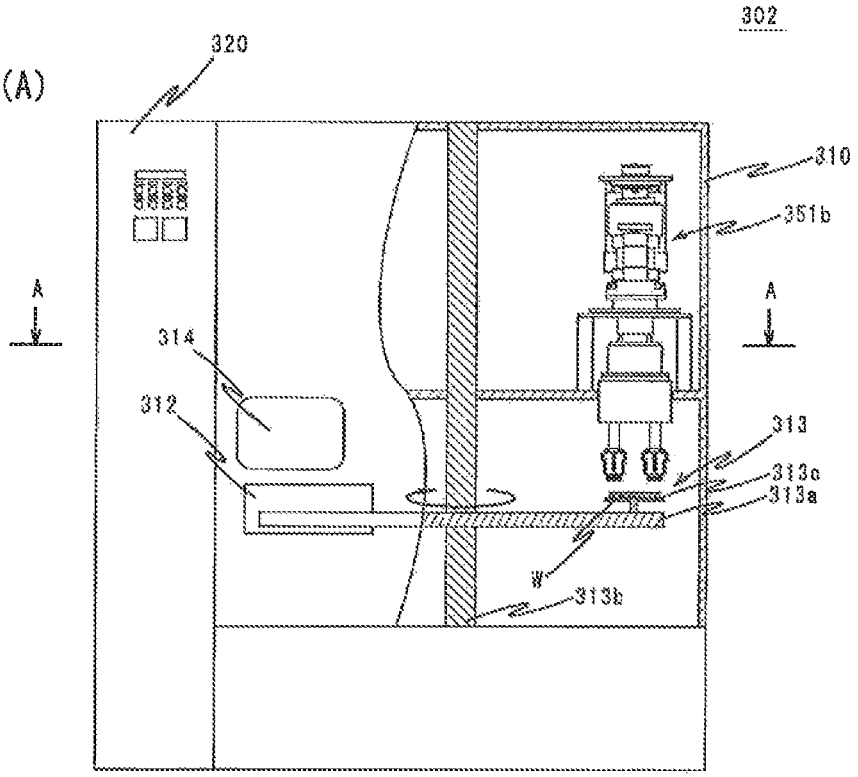
FIG. 11 is a schematic drawing of the system for brush-polishing that uses a turntable.
Figure 11:
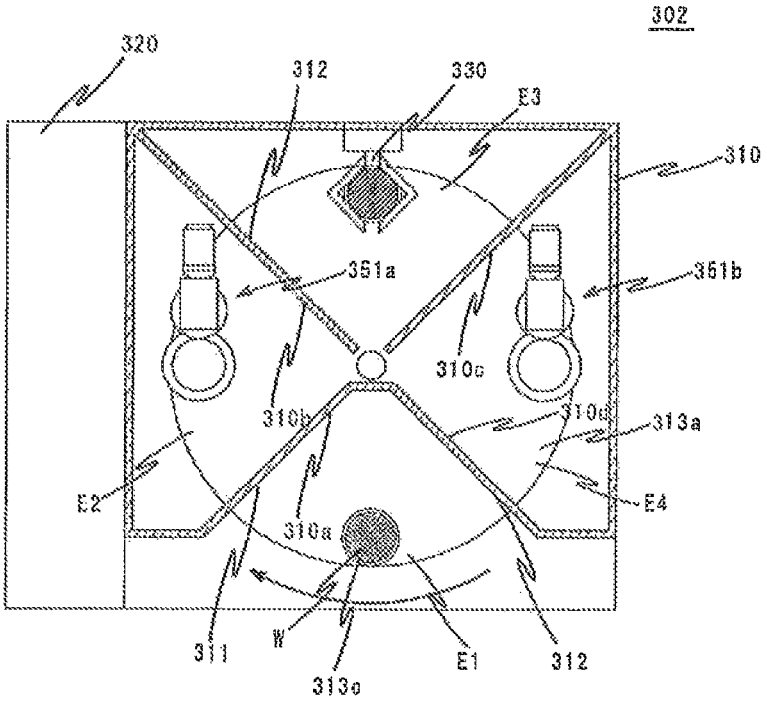

Next, discussed is the system 301 for brush-polishing that continuously polishes both the first surface of the workpiece W and the second surface, which is opposite the first surface. As in FIGS. 11(A) and (B), the system 301 for brush-polishing has a first brush unit 351*a* that polishes the first surface, a second brush unit 351*b* that polishes the second surface, a housing 310 that encloses the first brush unit 351*a* and the second brush unit 351*b*, a mechanism 330 for turning over the workpiece, which mechanism is located within the housing 310, and a controller 320 that controls the operations of the mechanism 313 for transporting the workpiece, the mechanism 330 for turning over the workpiece, the first brush unit 351*a*, and the second brush unit 351*b*. The first brush unit 351*a* and the second brush unit 351*b* may be the brush unit 01 of the first embodiment or the brush unit 51 of the second embodiment. Below, as an example the system 301 for brush-polishing that has the brush units 51 of the second embodiment for the first brush unit 351*a* and the second brush unit 351*b* is discussed. Mainly discussed are the points that differ from the device 201 for brush-polishing that uses a turntable.

Like the device 201 for brush-polishing that uses a turntable, the mechanism 213 for transporting the workpiece comprises a disc-shaped turntable 313*a*, a rotating shaft 313*b* that is fixed to the center of the plane of the turntable 313*a*, a mechanism for driving the turntable (not shown) that is connected to the rotating shaft 313*b*, and a plurality of portions 313*c* for placing the workpiece (four in FIG. 11) that are arranged at constant intervals on the turntable 313*a*.

The walls 310*a*, 310*b*, 310*c*, 310*d* of the housing 310 are radially arranged from the rotating shaft 313*b* at constant intervals so that the inner space of the housing 310 is divided into four areas, which are an area E1, for loading and unloading the workpiece, an area E2, for a first brush-polishing, an area E3, for turning over the workpiece, and an area E4, for a second brush-polishing. The area E1, for loading and unloading the workpiece is exposed to the outside by the walls 310*a*, 310*d*. Openings (a port 311 for loading and a port 312 for unloading), through which the portion 313*c* for placing the workpiece and the workpiece W can pass, are formed in the respective walls 310*a*, 310*d*. Further, the walls 310*b*, 310*c* are also configured to allow the portion 313*c* for placing the workpiece and the workpiece W to pass through them. For example, openings may be formed in the walls. Alternatively, the walls 310*b*, 310*c* may be made of a plurality of flexible strips that are suspended from the ceiling. In the latter case, since the lower ends of the strips are not anchored, the portion 313*c* for placing the workpiece and the workpiece W can pass through the walls 310*b*, 310*c*.

The first brush unit 351*a* is provided in the area E,2 for the first brush-polishing. The second brush unit 351*b* is provided in the area E4, for the second brush-polishing.

A mechanism 330 for turning over the workpiece that turns over the workpiece W that has been polished on the first surface is provided in the area E3, for turning over the workpiece. The mechanism 330 for turning over the workpiece has a portion for holding the workpiece that holds the workpiece W and an arm that is connected to the portion for holding the workpiece. The portion for holding the workpiece may be configured to grasp the workpiece W or to attract the workpiece W by suction or magnetic force. Alternatively, it may be configured so that the workpiece fits a groove that is formed in the portion for holding the workpiece. After the portion for holding the workpiece is moved by the arm to the position of the workpiece W, the workpiece W is held by the portion for holding the workpiece. Then the portion for holding the workpiece, i.e., the workpiece W, is turned over by the arm. The workpiece W is released from being held. In this way the workpiece W is turned over.

The conditions to polish, such as "the speed of the rotation," "the speed of the revolution," "the brush feed," "the rate of the bristles to be worn," and "duration for polishing," are input in the controller 320. In so far as the controller 320 can control the operation by inputting the conditions for polishing in it, a motion controller such as a programmable logic controller (PLC) and a digital signal processor (DSP), a personal computer, a multifunctional terminal, a smartphone, etc., can be used.

Next, a method for polishing the workpiece W by the system 301 for brush-polishing that uses a turntable is discussed. The points that differ from the method by using the device 201 for brush-polishing, which uses a turntable, which turntable is discussed above, are mainly discussed.

Before a polishing operation is started, the lower limiter 76*a* is adjusted so that the polishing brushes 60 are lowered to the standard position for lowering, like in the device 201 for brush-polishing, which uses a turntable. The conditions to polish are preliminarily input in the controller 320.

The workpiece W is placed on the portion 213*c* for placing the workpiece that is located in the area E1, for loading and unloading the workpiece. Then the "start operation button" of the controller 320 is pushed down at ON. First, the turntable 313*a* turns by 90° about the rotating shaft 313*b* so that the workpiece W moves under the first brush unit 351*a* by passing through the port 311 for loading that is formed in the wall 310*a*, and stops there.

Next, the mechanism 72 for driving the rotation and the mechanism 82 for driving the revolution are operated to follow the conditions to polish that are input in the controller 320 so that the polishing brushes 60 move as in the planetary motion. At this time, if the portion 313*c* for placing the workpiece is configured to rotate, it starts to rotate. Then the mechanism 76 for vertically moving and the mechanism 77 for adjusting the brush feed are operated so that the tips of the bristles of the polishing brushes 60 are pressed against the workpiece W by the predetermined "brush feed." Thus the polishing of the workpiece W starts.

When the "duration for polishing" that has been input in the controller 320 ends, the mechanism 76 for vertically moving is operated so that the polishing brushes 60 upwardly move, to be detached from the workpiece W. Next the mechanism 72 for driving the rotation and the mechanism 82 for driving the revolution stop so that the planetary motion of the polishing brushes 60 stops. At this time, if the portion 313*c* for placing the workpiece is configured to rotate, it also stops rotating. In this way the surface of one side of the workpiece W is polished.

Then the turntable 313*a* horizontally and clockwise turns by 90° so that the workpiece W moves to the area E3, for turning over the workpiece, and stops there. Then the mechanism for turning over the workpiece is operated to turn over the workpiece W, that is, the second surface is placed on the top. The workpiece W is again placed on the portion 313*c* for placing the workpiece.

Next, the turntable 313*a* horizontally and clockwise turns by 90° so that the workpiece W moves under the brush unit 51, that is, in the area E4, for the second brush-polishing, and stops there.

In the area E4, for the second brush-polishing, the second surface of the workpiece W is polished in the same process as that in the area E2, for the first brush-polishing.

Next, the turntable 313*a* horizontally and clockwise turns by 90° so that the workpiece W moves to the area E1, for loading and unloading the workpiece by passing through the port 312 for unloading that is formed in the wall 310*d*, and stops there. The workpiece W that has been polished on both surfaces is unloaded from the portion 313*c* for placing the workpiece. Thus the polishing of the workpiece is completed. Then a new workpiece W is placed and anchored on the portion 313*c* for placing the workpiece.

Please note that the step of loading and unloading the workpiece W on the portion 313*c* for placing the workpiece in the area E1, for loading and unloading the workpiece, the step of polishing the first surface in the area E2, for the first brush-polishing, the step of turning over the workpiece W in the area E3, for turning over the workpiece, and the step of polishing the second surface in the area E4, for the second brush-polishing, can be simultaneously carried out. As the workpieces W are continuously loaded and unloaded in the area E1, for loading and unloading the workpiece, a plurality of workpieces W can be continuously polished.

Since a window 314 is provided on the front face of the housing 310, the status of the polishing can be observed through the window 314.

Working Examples

The brush unit of the first embodiment and that of the second embodiment are attached to the conveyor-type device for brush-polishing so that the workpieces are polished in various conditions. The results are discussed as working examples. The valve plate that is shown in FIG. 7 and made of steel is used as the workpiece. It is a circular plate 100 mm in diameter and 3.5 mm thick. Ten large holes $H_1$ (10 mm in diameter) or nine small holes $H_2$ (4 mm in diameter) are formed by machining. The corners on both surfaces of these holes are rounded to have r=10-100 μm (R beveling process).

The workpieces W after being polished are observed by a microscope (KH-3000, available from Hirox, Japan) to evaluate the capabilities to remove burrs, as follows:

Good: No burrs on any holes

N.G.: Burrs remain on some holes

The capabilities to round corners are evaluated by using a contour measuring instrument (2600E, available from Tokyo Seimitsu, Japan) as follows:

Excellent: All the corners on the holes are rounded to have r=10-100 μm and the variance is within ±10%.

Good: All the corners on the holes are rounded to have r=10-100 μm, but the variance exceeds±10%.

N.G.: A corner or corners on the holes that are rounded do not have r=10-100 μm.

The brush unit of the first embodiment is attached to the conveyor-type device for brush-polishing, so that the workpieces are polished by the polishing brush that only rotates. The results are shown as comparative examples. The results by polishing the workpieces under the conditions to polish are listed in Table 1 with the conditions for polishing.

TABLE 1

| | Condiions to Brush-polish | | | | | | | | Evaluation | | | |
|---|---|---|---|---|---|---|---|---|---|---|---|---|
| | | Polishing Brush | | | Brush | Rotating | Revolving | Speed to | Removing Burrs | | R Beveling | |
| | Brush | Grain | Polishing Tool | | Feed | Speed | Speed | Transport | Large | Small | Large | Small |
| | Unit | Size | Number | Diameter | (mm) | ($min^{-1}$) | ($min^{-1}$) | (m/min) | Bores | Bores | Bores | Bores |
| Working Example 1 | First | F80 | 9 | 22 mm | 1.0 | 280 | 5 | 2.0 | Good | Good | Good | Poor |
| Working Example 2 | First | F80 | 9 | 22 mm | 1.0 | 1,720 | 30 | 2.0 | Good | Good | Good | Good |
| Working Example 3 | First | F180 | 9 | 22 mm | 1.5 | 280 | 5 | 2.0 | Good | Good | Good | Poor |
| Working Example 4 | First | F180 | 9 | 22 mm | 1.0 | 1,720 | 30 | 2.0 | Good | Good | Good | Good |
| Working Example 5 | First | F180 | 9 | 22 mm | 1.5 | 280 | 5 | 1.3 | Good | Good | Good | Good |
| Working Example 6 | Second | F80 | 6 × 4 | 12 mm | 1.0 | 400 | 17 | 2.0 | Good | Good | Excellent | Good |
| Working Example 7 | Second | F80 | 6 × 4 | 12 mm | 1.0 | 2,500 | 100 | 2.0 | Good | Good | Excellent | Excellent |
| Working Example 8 | Second | F180 | 6 × 4 | 12 mm | 1.0 | 400 | 17 | 2.0 | Good | Good | Excellent | Good |
| Working Example 9 | Second | F180 | 6 × 4 | 12 mm | 1.0 | 2,500 | 100 | 2.0 | Good | Good | Excellent | Excellent |
| Working Example 10 | Second | F180 | 6 × 4 | 12 mm | 1.0 | 2,500 | 100 | 2.5 | Good | Good | Excellent | Good |
| Working Example 11 | Second | F180 | 6 × 4 | 12 mm | 1.5 | 280 | 5 | 2.0 | Good | Good | Excellent | Good |
| Working Example 12 | Second | F180 | 6 × 4 | 12 mm | 1.0 | 1,720 | 30 | 2.0 | Good | Good | Excellent | Excellent |
| Comparative Example 1 | First | F180 | 9 | 22 mm | 1.5 | 280 | — | 2.0 | Good | Poor | Poor | Poor |
| Comparative Example 2 | First | F180 | 9 | 22 mm | 1.0 | 1,720 | — | 2.0 | Good | Poor | Poor | Poor |
| Comparative Example 3 | First | F180 | 9 | 22 mm | 1.5 | 280 | — | 1.3 | Good | Poor | Poor | Poor |
| Comparative Example 4 | First | F180 | 9 | 22 mm | 1.0 | 1,720 | — | 1.3 | Good | Good | Good | Poor |

After being polished by the brush unit of the first embodiment (working examples 1-5), no burrs are found at any corners on the large holes or small holes under any conditions for polishing. Thus the capabilities to remove burrs are evaluated as Good. The capabilities to round the corners are evaluated as Good for all large holes, but are Poor for the small holes if the speed of the rotation is low. However, by slowing the speed to transport the workpiece, i.e., decreasing the throughput speed, the evaluation changes to Good. As a result, the brush unit of the first embodiment successfully processes the workpiece.

After being polished by the brush unit of the second embodiment (working examples 6-12), no burrs are found at any corners on the large holes or small holes under any conditions for polishing. Thus the capabilities to remove burrs are evaluated as Good. The capabilities to round the corners are Excellent for all large holes. They are evaluated as Excellent or Good for the small holes. As shown in working examples 1-10, though the speed to transport the workpiece is accelerated, i.e., the throughput speed is increased, the capabilities remain Good. The Excellent evaluation indicates that the workpiece W is entirely and uniformly polished. Thus it is suggested that the brush unit of the second embodiment polishes the workpiece more efficiently than does the brush unit of the first embodiment.

By contrast, if the workpiece is polished by the polishing brush that only rotates, working examples 1-3 show that the capabilities to remove burrs and to round the corners are insufficient. As shown in working example 4, by increasing the speed of the rotation the capability to remove burrs and the capability to round the corners of the large hole are evaluated as Good, but the capability to round the corners of the small hole is evaluated as Poor. As a result, polishing by the brush unit of the present invention is suggested to have better capabilities to polish the workpiece than polishing by the polishing brush that only rotates.

From the results of working examples 1-12, it is shown that increasing the speed of the rotation causes the capabilities to polish the workpiece to be enhanced (for example, compare working examples 1 and 2) and increasing the speed of the revolution causes the entire workpiece to be uniformly polished (for example, compare working examples 6 and 7).

Figure 12:
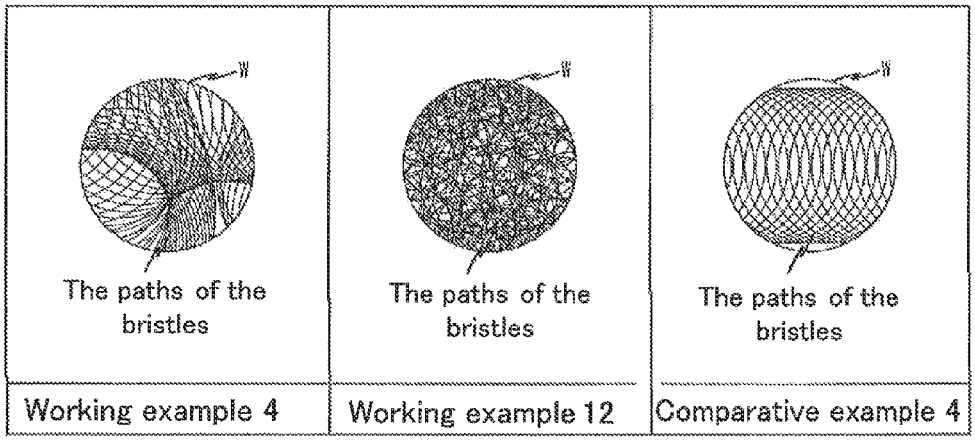
FIG. 12 is a schematic drawing illustrating the paths of the bristles in the embodiment.

In working examples 4 and 12 and comparative example 4, the paths of the bristles on the surface of the workpiece to be polished are shown as pattern diagrams in FIG. 12. If the paths are thick then the opportunity to contact the bristles with the surface of the workpiece to be polished is high, that is, the capabilities to polish the workpiece are high. As in FIG. 12, the gaps between the paths in comparative example 4 are the widest. After that the gaps between the paths are narrower in the order of working example 4 and working example 12. An area where no bristles contact the surface of the workpiece occurs in comparative example 4, but the bristles contact the entire areas of the workpieces in working examples 4 and 12. The results in FIG. 12 suggest that the device for brush-polishing having the brush unit of the present invention has higher capabilities to polish the workpiece than does the device for brush-polishing in which the polishing brush only rotates as in the working examples. They also indicate that the device for brush-polishing having the brush unit of the second embodiment has higher capabilities to polish the workpiece.

INDUSTRIAL APPLICABILITY

Though polishing the valve plates is discussed as a part of the embodiments, the use of the brush unit of the present invention is not limited to polishing them. It can be successfully used for the processes for rounding corners, the processes for removing burrs, and the processes for smoothing surfaces, of metallic mechanical parts, such as clutch plates and sintered gears.

Though polishing for rounding the corners is discussed as a part of the embodiments, the brush unit of the present invention can be successfully used in polishing for smoothing surfaces to be processed. For example, the roughness Ra (JIS B0601:1994) of the flat face in working example 10 was 12 μm before being polished, but 1.0 μm after being 0.38 polished. Thus it is suggested that the brush unit of the present invention can be successfully used in polishing the workpiece for smoothing the surfaces.

If the raw materials of the bristles are properly selected, the brush unit of the present invention can be successfully used for polishing brittle materials, such as silicon blocks, rock crystal, and ceramics. By polishing the workpiece by the device for brush-polishing of the present invention microcracks on the surface layer of the workpiece can be removed and the surface can be smoothed. For example, when the workpiece is to be sliced to manufacture a wafer any breaking or chipping originating at microcracks can be decreased. Thus the yield rate of the products can increase.

Below, the main reference numerals and symbols that are used in the detailed description and drawings are listed.

01: a brush unit (the first embodiment)
10: a polishing brush
11: a rotating member
12: a sliding shaft
13: a member for attaching the polishing tools
13*a*: a brush
13*b*: a fitting hole
13*c*: a bolt for fixing the polishing tools
13*d*: a fixing bolt
14: a polishing tool
14*a*: bristles
14*b*: a holder for the bristles
14*c*: a bundling member
15: a member for supporting the polishing tools
15*a*: a brush
15*b*: a hole for the insertion
20: a rotating unit
21: a mechanism for rotation
21*a*: a rotating shaft
21*b*: a sliding shaft
21*c*: a holder for rotation
21*d*: a member for holding the polishing brush
22: a mechanism for driving the rotation
23: a mechanism for transmitting the force for the rotation
23*a*: a pulley
23*b*: a V-belt
25: a vertically-moving plate
26: a mechanism for vertically moving
26*a*: a lower limiter
27: a mechanism for adjusting the brush feed
27*a*: a member for adjustment
27*b*: a mechanism for moving the member for adjustment
27*c*: a mechanism for transmitting the force for the adjustment
30: a revolving unit
31: a mechanism for the revolution
31*a*: a revolving plate
31*b*: a shaft for the revolution
32: a mechanism for driving the revolution
33: a mechanism for transmitting the force for the revolution
33*a*: a sprocket
33*b*: a chain
34: a rack for the mechanism for driving the revolution
40: a connecting unit
41: a connecting holder
42: a mechanism for controlling the angle to swing
42*a*: a member for the revolution
42*b*: a connecting member
42*c*: a sliding holder
51: a brush unit (the second embodiment)
60: a polishing brush
70: a rotating unit
71: a mechanism for rotation
71*a*: a rotating shaft
71*b*: a sliding shaft
71*c*: a holder for rotation
71*d*: a member for holding the polishing brush
71*e*: secondary rotating shafts
72: a mechanism for driving the rotation
73: a mechanism for transmitting the force for the rotation
73*a*: a timing pulley
73*b*: a timing belt
74: a secondary mechanism for transmitting the force for the rotation
74*a*: a gear at the side of the rotating shaft
74*b*: a gear at the side of the secondary rotating shafts
75: a vertically-moving plate
76: a mechanism for vertically moving
76*a*: a lower limiter
77: a mechanism for adjusting the brush feed
77*a*: a member for adjustment
77*b*: a mechanism for moving the member for adjustment
77*c*: a mechanism for transmitting the force for the adjustment
80: a revolving unit
81: a mechanism for the revolution
82: a mechanism for driving the revolution
83: a mechanism for transmitting the force for the revolution
83*a*: a gear at the side of the mechanism for the revolution
83*b*: a gear at the side of the mechanism for driving the revolution
90: a rack
101: a device for brush-polishing
102: a system for brush-polishing
102*a*: a first device for brush-polishing
102*b*: a second device for brush-polishing
102*c*: an intermediate mechanism for transporting the workpiece
110: a housing

111: a port for loading
112: a port for unloading
113: a mechanism for transporting the workpiece
113*a*: a driving roller
113*b*: a driven roller
113*c*: a belt
113*d*: a driver for transporting
113*e*: a mechanism for transmitting a force for the driving
114: a window
115: a door
120: a controller
201: a device for brush-polishing
210: a housing
211: a port for loading
213: a mechanism for transporting the workpiece
213*a*: a turntable
213*b*: a rotating shaft
213*c*: a portion for placing the workpiece
214: a window
220: a controller
302: a system for brush-polishing
310: a housing
311: a port for loading
312: a port for unloading
313: a mechanism for transporting the workpiece
313*a*: a turntable
313*b*: a rotating shaft
313*c*: a portion for placing the workpiece
314: a window
320: a controller
330: a mechanism for turning over the workpiece
351*a*: a first brush unit
351*b*: a second brush unit
B: a base for the installation
$H_1$: a large hole
$H_2$: a small hole
W: a workpiece

The invention claimed is:

1. A brush unit to polish a surface of a workpiece to be polished by means of a polishing brush that rotates and revolves in a planetary motion comprising: a polishing brush, wherein tips of a plurality of bristles are exposed from a bottom of the polishing brush;

a rotating unit having a mechanism for rotation having a rotating shaft that is connected to the polishing brush at one end, a sliding shaft, through which the rotating shaft is inserted so that the rotating shaft can be rotated, and a holder for rotation, through which the sliding shaft is slidably inserted, a mechanism for driving the rotation that generates a force for the rotating for rotating the polishing brush about the rotating shaft, a mechanism for transmitting the force for the rotation that transmits the force for the rotating to the rotating shaft, and a mechanism for vertically moving that moves the polishing brush toward the surface of the workpiece to be polished by means of the sliding shaft;

a revolving unit that is combined with the rotating unit, the revolving unit having a mechanism for a revolution that rotates so as to revolve the polishing brush, a mechanism for driving the revolution that generates a force for the revolution to revolve the polishing brush, and a mechanism for transmitting the force for the revolution that transmits the force for the revolution to the mechanism for driving the revolution, wherein the rotating unit further comprises a mechanism for adjusting brush feed that can adjust the brush feed to force the polishing brush against the workpiece, wherein the revolving unit comprises a disc-shaped revolving plate that is located at an outer side of the center of the brush unit, wherein the revolving olate engages the mechanism for rotation to allow the mechanism for rotation to swing, and a mechanism for controlling an angle to swing that controls the angle that the mechanism for rotation swings.

2. A brush unit to polish a surface of a workpiece to be polished by means of a polishing brush that rotates and revolves in a planetary motion comprising:

a polishing brush, wherein tips of a plurality of bristles are exposed from a bottom of the polishing brush;

a rotating unit having a mechanism for rotation having a rotating shaft that is connected to the polishing brush at one end, a sliding shaft, through which the rotating shaft is inserted so that the rotating shaft can be rotated, and a holder for rotation, through which the sliding shaft is slidably inserted, a mechanism for driving the rotation that generates a force for the rotating for rotating the polishing brush about the rotating shaft, a mechanism for transmitting the force for the rotation that transmits the force for the rotating to the rotating shaft, and a mechanism for vertically moving that moves the polishing brush toward the surface of the workpiece to be polished by means of the sliding shaft;

a revolving unit that is combined with the rotating unit, the revolving unit having a mechanism for a revolution that rotates so as to revolve the polishing brush, a mechanism for driving the revolution that generates a force for the revolution to revolve the polishing brush, and a mechanism for transmitting the force for the revolution that transmits the force for the revolution to the mechanism for driving the revolution, wherein the rotating unit comprises a plurality of the polishing brushes that are fixed to respective secondary rotating shafts at their ends, the other ends of the secondary rotating shafts being combined with a secondary mechanism for transmitting the force for the rotation that transmits the force for the rotating from the end of the rotating shaft, wherein a plurality of polishing brushes are connected to the rotating shaft, wherein the holder for rotation is held by the mechanism for the revolution so that the axial center of the mechanism for the revolution is consistent with the axial center of the rotating shaft.

3. The brush unit of claim 1, wherein the polishing brush is a segmented brush that holds a plurality of polishing tools by a tool for fixing the bristles, the polishing tools being made by bundling up a plurality of bristles and fixing one end of the bundle to the polishing tool for fixing the bristles.

4. The brush unit of claim 1, wherein the bristles are made of a monofilament that is made from a nylon resin that includes abrasive grains having grain sizes of F54 to F240 or #240 to #1000.

5. A device for brush-polishing that comprises the brush unit of claim 1 and a mechanism for transporting the workpiece that transports the workpiece under the polishing brush, wherein the mechanism for transporting the workpiece is a turntable that has areas for placing the workpiece and intermittently and horizontally turns to transport the workpiece to the position under the polishing brush.

6. A device for brush-polishing that comprises the brush unit of claim 1 and a mechanism for transporting the workpiece that transports the workpiece under the polishing brush, wherein the mechanism for transporting the workpiece is a conveyor belt that continuously and linearly transports the workpiece under the polishing brush.

7. A system for brush-polishing that polishes both a first surface, and a second surface that is opposite the first surface, of a workpiece, the system comprising: a first device for brush-polishing that polishes the first surface, which device is defined in claim 6; a second device for brush-polishing that polishes the second surface, which device is defined in claim 6; and an intermediate mechanism for transporting the workpiece that transports the workpiece from the first device for brush-polishing to the second device for brush-polishing; wherein the system further comprises a mechanism for turning over the workpiece at the end of the mechanism for transporting the workpiece in a direction that the workpiece is transported.

8. A system for brush-polishing that polishes both a first surface, and a second surface that is opposite the first surface, of a workpiece, the system comprising: a first brush unit that polishes the first surface, which unit is defined in claim 1; a second brush unit that polishes the second surface, which unit is defined in claim 1; a mechanism for transporting the workpiece that has the areas for placing the workpiece and intermittently turns to transport the workpiece under the polishing brush; and a mechanism for turning over the workpiece, which mechanism is located between the first brush unit and the second brush unit on the path of the workpiece.

9. A method for brush-polishing that uses the brush unit of claim the method comprising the steps of: rotating the polishing brush; revolving the polishing brush; polishing a surface of a workpiece to be polished by contacting the polishing brush that rotates and revolves with the workpiece; and separately adjusting a speed of the rotation and a speed of the revolution of the polishing brush.

10. The brush unit of claim 2, wherein the polishing brush is a segmented brush that holds a plurality of polishing tools by a tool for fixing the bristles, the polishing tools being made by bundling up a plurality of bristles and fixing one end of the bundle to the polishing tool for fixing the bristles.

11. The brush unit of claim 2, wherein the bristles are made of a monofilament that is made from a nylon resin that includes abrasive grains having grain sizes of F54 to F240 or #240 to #1000.

12. A device for brush-polishing that comprises the brush unit of claim 2 and a mechanism for transporting the workpiece that transports the workpiece under the polishing brush, wherein the mechanism for transporting the workpiece is a turntable that has areas for placing the workpiece and intermittently and horizontally turns to transport the workpiece to the position under the polishing brush.

13. A device for brush-polishing that comprises the brush unit of claim 2 and a mechanism for transporting the workpiece that transports the workpiece under the polishing brush, wherein the mechanism for transporting the workpiece is a conveyor belt that continuously and linearly transports the workpiece under the polishing brush.

14. A system for brush-polishing that polishes both a first surface, and a second surface that is opposite the first surface, of a workpiece, the system comprising:

- a first device for brush-polishing that polishes the first surface, which device is defined in claim 13;
- a second device for brush-polishing that polishes the second surface, which device is defined in claim 13; and
- an intermediate mechanism for transporting the workpiece that transports the workpiece from the first device for brush-polishing to the second device for brush-polishing;
- wherein the system further comprises a mechanism for turning over the workpiece at the end of the mechanism for transporting the workpiece in a direction that the workpiece is transported.

15. A system for brush-polishing that polishes both a first surface, and a second surface that is opposite the first surface, of a workpiece, the system comprising:

- a first brush unit that polishes the first surface, which unit is defined in claim 2;
- a second brush unit that polishes the second surface, which unit is defined in claim 2;
- a mechanism for transporting the workpiece that has the areas for placing the workpiece and intermittently turns to transport the workpiece under the polishing brush; and
- a mechanism for turning over the workpiece, which mechanism is located between the first brush unit and the second brush unit on the path of the workpiece.

16. A method for brush-polishing that uses the brush unit of claim 2, the method comprising the steps of:

- rotating the polishing brush;
- revolving the polishing brush;
- polishing a surface of a workpiece to be polished by contacting the polishing brush that rotates and revolves with the workpiece; and
- separately adjusting a speed of the rotation and a speed of the revolution of the polishing brush.

* * * * *